US011059645B2

(12) United States Patent
Chambers et al.

(10) Patent No.: US 11,059,645 B2
(45) **Date of Patent: *Jul. 13, 2021**

(54) LOCKING PACKAGING CONTAINER

(71) Applicant: All Packaging Company, Aurora, CO (US)

(72) Inventors: Christopher Chambers, Aurora, CO (US); Eric Gilger, Aurora, CO (US)

(73) Assignee: All Packaging Company, Aurora, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/653,781

(22) Filed: Oct. 15, 2019

(65) Prior Publication Data

US 2020/0039717 A1 Feb. 6, 2020

Related U.S. Application Data

(62) Division of application No. 15/487,113, filed on Apr. 13, 2017, now Pat. No. 10,479,581.

(Continued)

(51) Int. Cl.
*B65D 77/22* (2006.01)
*B65D 5/42* (2006.01)

(Continued)

(52) U.S. Cl.
CPC ..... *B65D 77/22* (2013.01); *B65D 5/0254* (2013.01); *B65D 5/10* (2013.01); *B65D 5/2057* (2013.01);

(Continued)

(58) Field of Classification Search
CPC ..... B65D 5/38; B65D 77/22; B65D 5/0254; B65D 5/10; B65D 5/2057; B65D 5/4204; B65D 5/4266; B65D 5/48014; B65D 5/5035; B65D 77/042; B65D 2215/02; B65D 2215/04; B65D 5/6664

(Continued)

(56) References Cited

U.S. PATENT DOCUMENTS 3,241,738 A 3/1966 Freiman
4,561,544 A * 12/1985 Reeve ..... B65D 11/12 206/1.5

(Continued)

OTHER PUBLICATIONS

Search Report issued in EP17905313.7 dated Apr. 28, 2020, 2 pgs.

(Continued)

*Primary Examiner* — Steven A. Reynolds
(74) *Attorney, Agent, or Firm* — Holland & Hart LLP

(57) ABSTRACT

The technology disclosed herein includes a packaging apparatus including an outer sleeve, an inner sleeve, and at least one locking mechanism configured to lock the inner sleeve inside the outer sleeve. In some implementations, the locking mechanism is an interior sliding mechanism, which locks the inner sleeve in its entirety in the outer sleeve. In some implementations, the locking mechanism is an interior sliding mechanism, which permits the inner sleeve to move partially out of the outer sleeve. In some implementations, the locking mechanism includes a spring, a tab, a flap, a key, a magnet lock, or other locking component. In some implementations, the inner sleeve includes a pull tab for removal of the inner sleeve from inside the outer sleeve.

20 Claims, 16 Drawing Sheets

Related U.S. Application Data

(60) Provisional application No. 62/322,614, filed on Apr. 14, 2016.

(51) Int. Cl.

| | |
|---|---|
| ***B65D 5/48*** | (2006.01) |
| ***B65D 5/50*** | (2006.01) |
| ***B65D 5/10*** | (2006.01) |
| ***B65D 5/02*** | (2006.01) |
| ***B65D 5/20*** | (2006.01) |
| ***B65D 5/38*** | (2006.01) |
| ***B65D 77/04*** | (2006.01) |

(52) U.S. Cl.
CPC ..... *B65D 5/38* (2013.01); *B65D 5/4204* (2013.01); *B65D 5/4266* (2013.01); *B65D 5/48014* (2013.01); *B65D 5/5007* (2013.01); *B65D 5/5035* (2013.01); *B65D 77/042* (2013.01); *B65D 2215/02* (2013.01); *B65D 2215/04* (2013.01)

(58) Field of Classification Search
USPC ..... 206/1.5, 528, 538
See application file for complete search history.

(56) References Cited

U.S. PATENT DOCUMENTS

| | | | | |
|---|---|---|---|---|
| 6,641,031 | B2 * | 11/2003 | Evans | B65D 5/38 206/532 |
| 7,708,142 | B2 | 5/2010 | Ehrlund | |
| 7,757,843 | B2 * | 7/2010 | Katsis | A24F 27/00 206/1.5 |
| 7,854,325 | B2 | 12/2010 | Bentele | |
| 8,011,512 | B2 | 9/2011 | Brollier et al. | |
| 8,453,840 | B2 | 6/2013 | Wharton | |
| 8,567,607 | B2 | 10/2013 | Fischer | |
| 8,701,889 | B2 | 4/2014 | Loftin | |
| 9,475,605 | B2 | 10/2016 | Everett | |
| 9,783,335 | B2 | 10/2017 | Everett | |
| 9,981,788 | B2 * | 5/2018 | Skinner | B65D 50/046 |
| 10,479,581 | B2 * | 11/2019 | Chambers | B65D 5/5035 |
| 10,518,927 | B2 * | 12/2019 | Chambers | B65D 5/5007 |
| 2004/0099565 | A1 | 5/2004 | Dehlin et al. | |
| 2007/0175789 | A1 | 8/2007 | Ronnberg et al. | |
| 2007/0181458 | A1 * | 8/2007 | Ehrlund | B65D 5/38 206/528 |
| 2008/0217197 | A1 | 9/2008 | Peters et al. | |
| 2008/0314780 | A1 | 12/2008 | Weston | |
| 2009/0152134 | A1 | 6/2009 | Katsis | |
| 2009/0255832 | A1 * | 10/2009 | Bentele | B65D 5/38 206/1.5 |
| 2011/0036743 | A1 * | 2/2011 | Wharton | B65D 5/38 206/531 |
| 2012/0261275 | A1 | 10/2012 | Intini | |
| 2013/0140201 | A1 | 6/2013 | Ghini | |
| 2016/0001937 | A1 * | 1/2016 | Skinner | B65D 5/38 206/1.5 |
| 2016/0152373 | A1 * | 6/2016 | Linssen | B65D 5/38 206/1.5 |
| 2016/0251107 | A1 | 9/2016 | Everett | |
| 2017/0036808 | A1 * | 2/2017 | Everett | B65D 5/38 |
| 2017/0072452 | A1 | 3/2017 | Monetti et al. | |
| 2017/0217658 | A1 * | 8/2017 | Whitehurst | B65D 79/00 |
| 2017/0297803 | A1 | 10/2017 | Chambers et al. | |
| 2018/0022498 | A1 * | 1/2018 | Everett | B65D 5/541 206/1.5 |
| 2018/0072452 | A1 | 3/2018 | Chambers | |
| 2018/0105314 | A1 | 4/2018 | Jones | |
| 2019/0225366 | A1 | 7/2019 | Whitehurst | |
| 2019/0337689 | A1 | 11/2019 | Mazurek et al. | |
| 2020/0087020 | A1 * | 3/2020 | Tsai | B65D 5/443 |
| 2020/0108970 | A1 | 4/2020 | Chambers | |

OTHER PUBLICATIONS

International Report on Patentability issued in International Application PCT/US2017/061858 dated Oct. 15, 2019, 5 pgs.
Supplementary European Search Report issued in EP17905313 dated Dec. 14, 2020, 2 pgs.
Written Opinion issued in PCT/US2017/061858 dated Jan. 31, 2018, 4 pgs.

* cited by examiner

LOCKING PACKAGING CONTAINER

PRIORITY CLAIM

This application is a divisional of prior U.S. patent application Ser. No. 15/487,113 filed Apr. 13, 2017, which claims the benefit of priority to U.S. Patent Application No. 62/322,614 filed Apr. 14, 2016, the entire disclosures of which are incorporated herein by reference for all purposes.

BACKGROUND

Cartons or other paperboard containers may be used for holding and storing items. In some implementations, the items held or stored in the containers may be harmful to certain users, such as children (e.g., a pharmaceutical drug). A user may desire to hold or store items in a lockable, child-resistant container.

SUMMARY

The technology disclosed herein includes a packaging apparatus comprising an outer sleeve, an inner sleeve, and at least one locking mechanism configured to lock the inner sleeve inside the outer sleeve. In some implementations, the locking mechanism is an interior sliding mechanism, which locks the inner sleeve in its entirety in the outer sleeve. In some implementations, the locking mechanism is an interior sliding mechanism, which permits the inner sleeve to move partially out of the outer sleeve. In some implementations, the locking mechanism includes a spring, a tab, a flap, a key, a magnet lock, or other locking component. In some implementations, the inner sleeve includes a pull tab for removal of the inner sleeve from inside the outer sleeve.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations as further illustrated in the accompanying drawings and defined in the appended claims.

These and various other features and advantages will be apparent from a reading of the following Detailed Description.

DETAILED DESCRIPTION

In the following description, for the purposes of explanation, numerous specific details are set forth in order to provide a thorough understanding of the present invention. It will be apparent, however, to one skilled in the art that the present invention may be practiced without some of these specific details. For example, while various features are ascribed to particular implementations, it should be appreciated that the features described with respect to one implementation may be incorporated with some implementations as well. Similarly, however, no single feature or features of any described implementation should be considered essential to the invention, as some implementations of the invention may omit such features. For purposes of this disclosure, the term "substantially parallel" refers to a position wherein a tab lies sufficiently flat in relation to a first surface in an effort to slide between the first surface and a second surface opposing the first surface. For example, in some implementations, "substantially parallel" may be 0°-5° from the first surface. For purposes of this disclosure, the term "protruding" refers to a position wherein a tab extends from a first surface through an aperture in an effort to prevent movement and create a locking mechanism as the tab is trapped in the aperture. For example, in some implementations, "protruding" may mean a tab extends 10°-30° from the first surface. In some implementations, the tab may extend more than 10°-30°.

The disclosed technology includes packaging apparatuses configured to lock internally. In some implementations, the packaging apparatus may have a compartment or an insert containing a compartment to hold, store, and secure an item. The packaging apparatus are child-resistant, easy to manufacture, and easy to use. In some implementations, the packaging apparatus are made of paperboard and have folding capabilities. In some implementations, the packaging apparatus may be tamper-evident and/or senior-friendly. The packaging apparatus include panels, tabs, flaps, and apertures that may have various shapes (e.g., oval, rectangular, circular, etc.) depending on the intended use and manufacturing requirements (e.g., auto-erecting walls requirements). The panels, tabs, flaps, apertures, and other components of the packaging apparatus may have different locations in the packaging apparatus than what is shown in the figures. For example, a panel or tab may be moved in a packaging apparatus to accommodate better functioning of one of the disclosed locking mechanisms.

Figure 1:
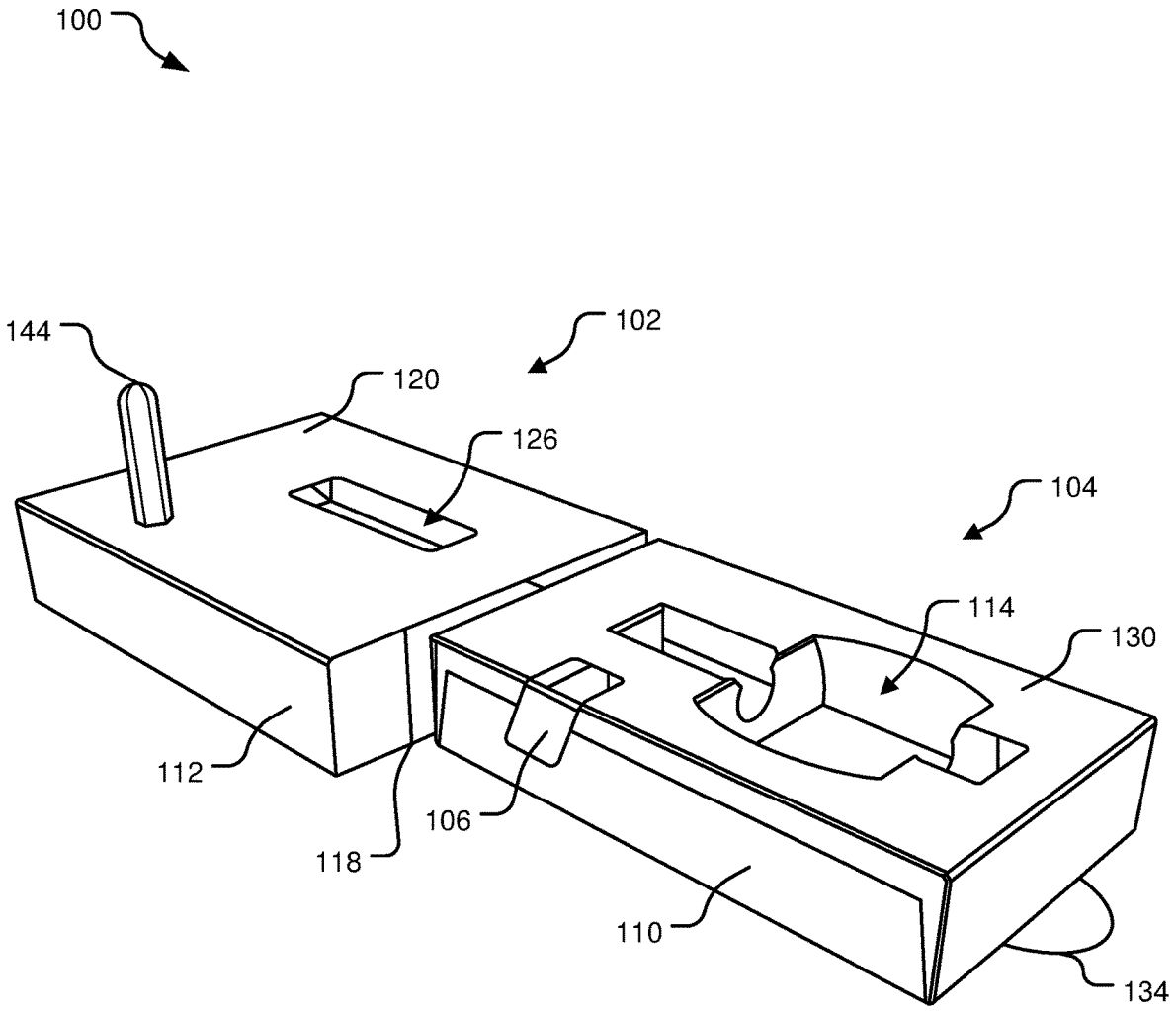
FIG. 1 illustrates a perspective view of an example packaging apparatus.

FIG. 1 illustrates a perspective view of an example packaging apparatus 100. The packaging apparatus 100 has an outer sleeve 102, an inner sleeve 104, and an interior sliding locking mechanism (described more below in detail) configured to lock the inner sleeve 104 inside the outer sleeve 102. In some implementations, there may be more than one locking mechanism.

In the implementation shown in FIG. 1, the sliding locking mechanism includes a tab 106 located on the inner sleeve 104. The tab 106 may have a springing mechanism where the tab 106 extends from the inner sleeve 104 in a resting condition, and when the tab 106 is pushed against a side 110 of the inner sleeve 104 and released, the tab 106 springs back in a preferred direction to a position extending from the inner sleeve 104.

The inner sleeve 104 has a compartment 114 on a front panel 130 for holding items in place, and for storing items in the outer sleeve 102. The compartment 114 can vary in design and shape depending on the design and use of the packaging apparatus 100, as well as the required design for desired items to be stored in the outer sleeve 102. For example, the compartment 114 may be designed to securely hold vials, bottles, a vape cartridge, electronic cigarettes, other objects, etc. in place. In some implementations, there may be multiple compartments 114.

Before the inner sleeve 104 is inserted into the outer sleeve 102 for locking, the tab 106 protrudes from an edge on the side 110 of the inner sleeve 104, as shown in FIG. 1. In order to insert the inner sleeve 104 into the outer sleeve 102, the tab 106 can be moved or depressed by an instrument or a user's finger toward the side 110 of the inner sleeve 104 until the tab 106 is substantially parallel or flush with the side 110 of the inner sleeve 104.

Once the tab 106 is substantially parallel or flush with the side 110 of the inner sleeve 104, the inner sleeve 104 may be inserted into the outer sleeve 102 in between two interior walls of the outer sleeve 102. In the implementation shown in FIG. 1, there is an interior wall 118 located approximately in between a side panel 112 of the outer sleeve 102 and the middle of the outer sleeve 102. In another implementation, one or both of the interior walls of the outer sleeve 102 may be on side panels 112 of the outer sleeve 102. In some implementations, the interior walls 118 may be located in other locations inside the outer sleeve 102.

The inner sleeve 104 may be inserted into the outer sleeve 102 in between interior walls of the outer sleeve 102 until the tab 106 locks into the outer sleeve 102. The locking mechanism can occur automatically when the tab 106 moves or springs into a first aperture (not shown in FIG. 1, see first aperture 216 in FIG. 2) in the interior wall 118 of the outer sleeve 102, and the tab 106 moves from a position parallel to the side of the inner sleeve 104 to a position perpendicular to the side 110 of the inner sleeve 104, locking the inner sleeve 104 in place inside the interior wall 118 of the outer sleeve 102. In some implementations, the locking mechanism may not occur automatically and may require manual assistance.

In FIG. 1, a second aperture (not shown) is located in the front panel 120 of the outer sleeve 102. In some implementations, a third aperture (see third aperture 224 in FIG. 2) may be located on a bottom panel (not shown) of the outer sleeve 102. An instrument or key 144 may be inserted into either the second aperture or a third aperture, to depress or push down on the tab 106 until it is flush or parallel with the side 110 of the inner sleeve 104 to unlock the inner sleeve 104 from the outer sleeve 102, and allow the inner sleeve 104 to slide out of the outer sleeve 102 while the instrument or key 144 is engaged. On FIG. 1, the instrument 144 is shown inserted in the second aperture, therefore the second aperture is not visible in FIG. 1. Once the inner sleeve 104 is removed from the outer sleeve 102, contents in the inner sleeve 104 are accessible. In some implementations, other apertures may be contemplated for access to the locking mechanism.

In the implementation shown in FIG. 1, a window 126 is located in the front panel 120 of the outer sleeve 102. The window 126 may be an aperture or a clear material (e.g., plastic or glass) for observation or visibility of items held in the compartment 114 on the front panel 130 of the inner sleeve 104. In some implementations, the inner sleeve 104 can be reversible and optionally be rotated 180° degrees and inserted into the outer sleeve 102 with the bottom panel (not shown) of the inner sleeve 104 observed through the window 126. In such implementations, when the inner sleeve 104 is locked in the outer sleeve 102, the tab 106 of the inner sleeve 104 will be parallel or flush with the bottom panel (not shown) of the outer sleeve 102. In order to unlock the inner sleeve 104, the instrument or key 144 may be inserted into a third aperture (e.g., third aperture 224 shown in FIG. 2) to depress or push down on the tab 106 until it is flush or parallel with the side 110 of the inner sleeve 104 to unlock the inner sleeve 104 from the outer sleeve 102, and allow the inner sleeve 104 to slide out of the outer sleeve 102.

In some implementations, as shown in FIG. 1, the inner sleeve 104 may have a pull tab 134 for easier insertion and removal of the inner sleeve 104 into and from the outer sleeve 102. In some implementations, a locking mechanism in the packaging apparatus 100 can include a spring, a key, and/or a magnet.

The components of the packaging apparatus 100 can comprise of one or more materials (i.e., paperboard, plastic, etc.). For example, in some implementations, all of the packaging apparatus 100 may be paperboard of varying thickness. In some implementations, the inner sleeve 104 and the outer sleeve 102 may be paperboard and the tab 106 may be plastic. In some implementations, the interior walls 118 of the outer sleeve 102 may have a lining or tray made of a material different than the outer sleeve 102. For example, the outer sleeve 102 may be made of paperboard, and a lining on the interior walls 118 of the outer sleeve 102 may be plastic or another material that cannot be ripped or torn, reinforcing the child-resistant nature of the packaging apparatus 100. Or in another implementation, the inner sleeve 104 may be made of both a plastic material and a paperboard material to provide additional durability. In some implementations, scoring of the tabs 106 may allow for memory, and different thicknesses of material may be used for rigidity. In some implementations, plastic laminate may be included in the packaging apparatus so that it is tear-proof. The tab location can vary and may be dependent on the shape of the compartment.

Figure 2:
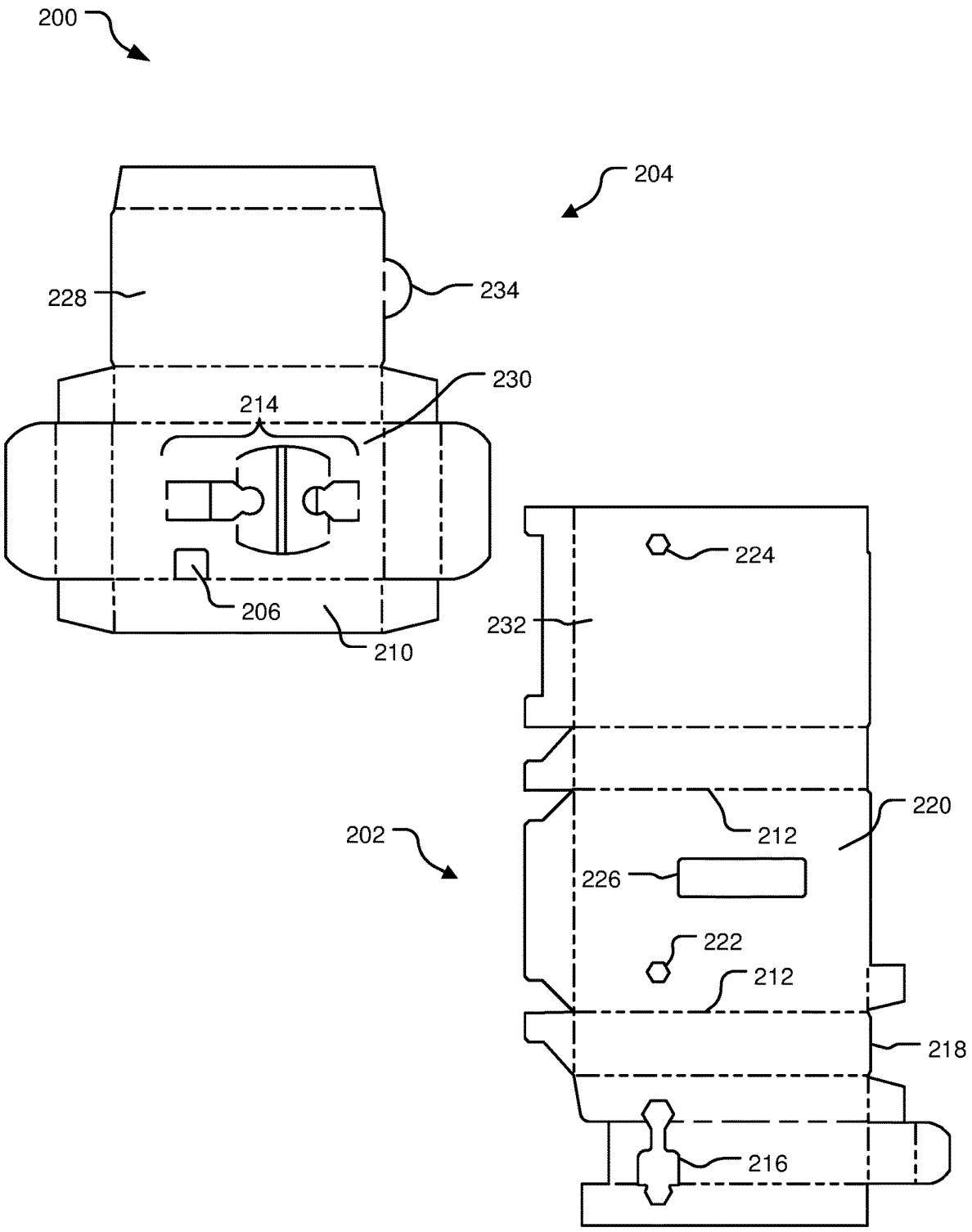
FIG. 2 illustrates a plan view of an unassembled example packaging apparatus.

FIG. 2 illustrates a side view of an unassembled example packaging apparatus 200, including an outer sleeve 202, an inner sleeve 204, and an interior sliding locking mechanism (described more below in detail) configured to lock the inner sleeve 204 inside the outer sleeve 202 once assembled. In this implementation, the sliding locking mechanism includes a tab 206 located on the inner sleeve 204.

The dashed lines in FIG. 2 depict where the material of the packaging apparatus may be folded when it is assembled. In some implementations, the dashed lines are perforated edges wherein panels, tabs, or flaps may fold. For example, a perforated edge may be where a panel, tab, or flap folds backwards against a surface (e.g., clay coating) of material (e.g., paperboard).

The inner sleeve 204 has a compartment 214 on a front panel 230 for holding items in place, and for storing items in a locked outer sleeve 202. The compartment 214 can vary depending on the design and use of the packaging apparatus 200, as well as the required design for desired items to be stored in the outer sleeve 202. For example, the compartment 214 may be designed to securely hold vials, bottles, electronic cigarettes, etc. in place. In some implementations, there may be multiple compartments 214.

Before the inner sleeve 204 is inserted into the outer sleeve 202 for locking, the tab 206 extends perpendicularly from an edge on the side of the inner sleeve 204. In order to insert the inner sleeve 204 into the outer sleeve 202, the tab 206 can be moved or depressed by an instrument or a user's finger toward the side 210 of the inner sleeve 204 until the tab 206 is substantially parallel or flush with the side 210 of the inner sleeve 204.

Once the tab 206 is substantially parallel or flush with the side 210 of the inner sleeve 204, the inner sleeve 204 may be inserted into the outer sleeve 202 in between two interior walls 218 of the outer sleeve 202. In the implementation shown in FIG. 2, there is an interior wall 218 located approximately in between a side panel 212 of the outer sleeve 202 and the middle of the outer sleeve 202. In another implementation, one or both of the interior walls 218 of the outer sleeve 202 may be on the side panel 212 of the outer sleeve 202. In some implementations, the interior walls 218 may be located in other locations inside the outer sleeve 202.

The inner sleeve 204 may be inserted into the outer sleeve 202 in between two interior walls until the tab 206 locks into the outer sleeve 202. The locking mechanism can occur automatically when the tab 206 moves into a first aperture 216 in the interior wall 218 of the outer sleeve, and the tab 206 moves from a position parallel to the side of the inner sleeve 204 to a position perpendicular to the side 210 of the inner sleeve 204, locking the inner sleeve 204 in place inside the interior wall 218 of the outer sleeve 204. In some implementations, the locking mechanism may not occur automatically and may require manual assistance.

In addition to locating in a position perpendicular to the side 210 of the inner sleeve 204, the tab 206 is now parallel or flush with the front panel 220 of the outer sleeve 202. In FIG. 2, a second aperture 222 is located in the front panel 220 of the outer sleeve 202, and a third aperture 224 is located on a bottom panel 232 of the outer sleeve 202. An instrument or key (not shown) may be inserted into either the second aperture 222 or the third aperture 224, to depress or push down on the tab 206 until it is flush or parallel with the side 210 of the inner sleeve 204 to unlock the inner sleeve 204 from the outer sleeve 202, and allow the inner sleeve 204 to slide out of the outer sleeve 202. Once the inner sleeve 204 is removed from the outer sleeve 202, contents in the inner sleeve 204 are accessible. In some implementations, other apertures may be contemplated for access to the locking mechanism.

In the implementation shown in FIG. 2, a window 226 is located in the front panel 220 of the outer sleeve 202. The window 226 may be an aperture or a clear material (e.g., plastic or glass) for observation of items held in the compartment 214 on the front panel 220 of the inner sleeve 204. In some implementations, the inner sleeve 204 can optionally be rotated 180° degrees and inserted into the outer sleeve 202 with a bottom panel 228 of the inner sleeve 204 observed through the window 226. In such implementations, when the inner sleeve 204 is locked in the outer sleeve 202, the tab 206 of the inner sleeve 204 will be parallel or flush with a bottom panel 232 of the outer sleeve 202. In order to unlock the inner sleeve 204, an instrument or key (not shown) may be inserted into the third aperture 224 to depress or push down on the tab 206 until it is flush or parallel with the side 210 of the inner sleeve 204 to unlock the inner sleeve 204 from the outer sleeve 202, and allow the inner sleeve 204 to slide out of the outer sleeve 202.

In some implementations, as shown in FIG. 2, the inner sleeve 204 may have a pull tab 234 for easier insertion and removal of the inner sleeve 204 into and from the outer sleeve 202. In some implementations, a locking mechanism in the packaging apparatus 200 can include a spring, a key and/or a magnet.

The components of the packaging apparatus 200 can comprise of one or more materials (i.e., paperboard, plastic, etc.). For example, in some implementations, all of the packaging apparatus 200 may be paperboard of varying thickness. In some implementations, the inner sleeve 204 and the outer sleeve 202 may be paperboard and the tab 206 may be plastic. In some implementations, the interior walls 218 of the outer sleeve 202 may have a lining made of a material different than the outer sleeve 202. For example, the outer sleeve 202 may be made of paperboard, and a lining on the interior walls of the outer sleeve 202 may be plastic or another material that cannot be ripped or torn, reinforcing the child-resistant nature of the packaging apparatus 200.

Figure 3:
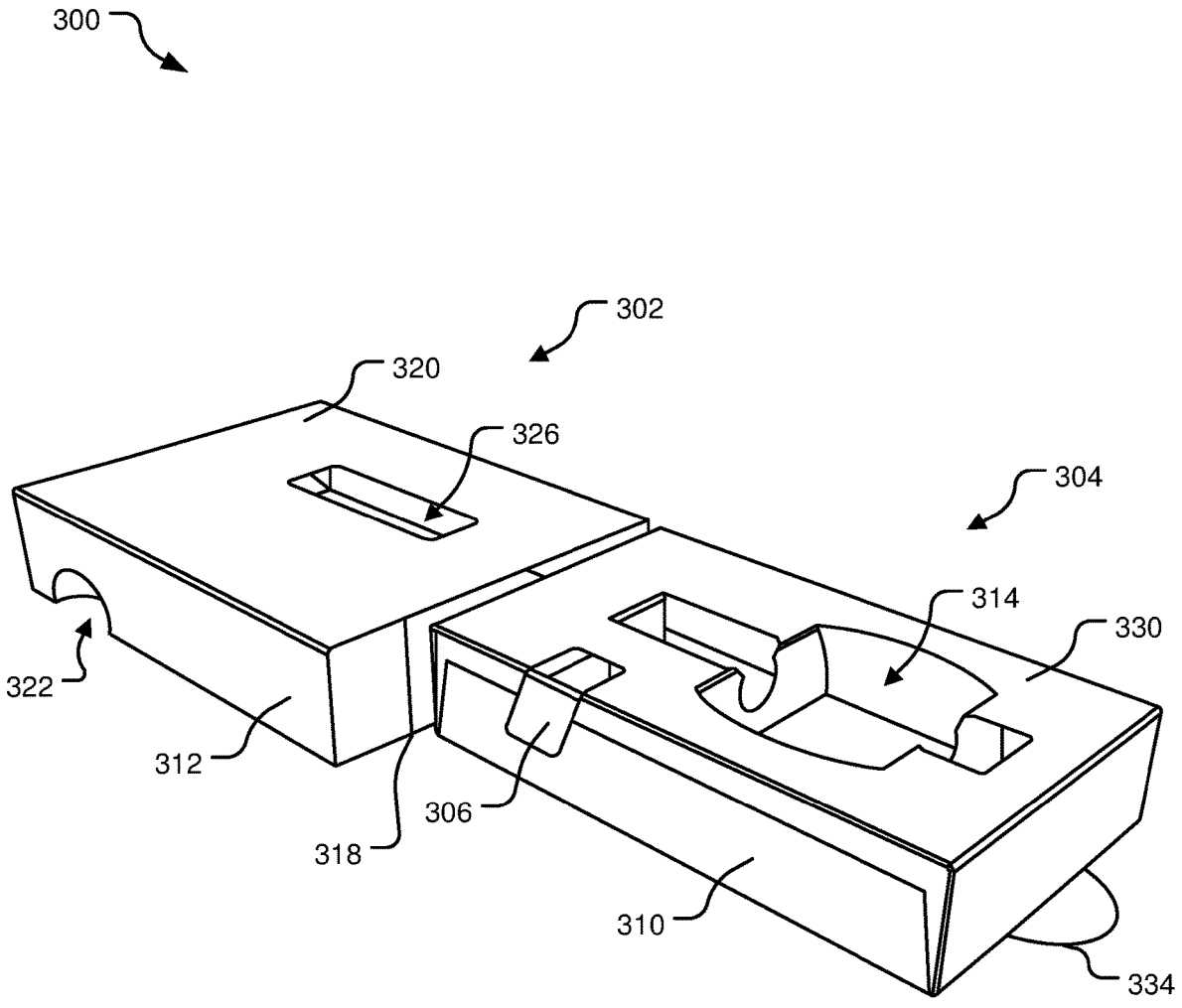
FIG. 3 illustrates a perspective view of an example packaging apparatus.

FIG. 3 illustrates a perspective view of an example packaging apparatus 300. The packaging apparatus 300 has an outer sleeve 302, an inner sleeve 304, and an interior sliding locking mechanism (described more below in detail) configured to lock the inner sleeve 304 inside the outer sleeve 302. In this implementation, the sliding locking mechanism includes a tab 306 located on the inner sleeve 304.

The inner sleeve 304 has a compartment 314 on a front panel 330 for holding items in place, and for storing items in a locked outer sleeve 302. The compartment 314 can vary depending on the design and use of the packaging apparatus 300, as well as the required design for desired items to be stored in the outer sleeve 302. For example, the compartment 314 may be designed to securely hold vials, bottles, electronic cigarettes, etc. in place. In some implementations, there may be multiple compartments 314.

Before the inner sleeve 304 is inserted into the outer sleeve 302 for locking, the tab 306 extends perpendicularly from an edge on the side of the inner sleeve 304, as shown in FIG. 3. In order to insert the inner sleeve 304 into the outer sleeve 302, the tab 306 can be moved or depressed by an instrument or a user's finger toward the side 310 of the inner sleeve 304 until the tab 306 is substantially parallel or flush with the side 310 of the inner sleeve 304.

Once the tab 306 is substantially parallel or flush with the side 310 of the inner sleeve 304, the inner sleeve 304 may be inserted into the outer sleeve 302 in between two interior walls of the outer sleeve 302. In the implementation shown in FIG. 3, there is an interior wall 318 located approximately in between a side panel 312 of the outer sleeve 302 and the middle of the outer sleeve 302. In another implementation, one or both of the interior walls of the outer sleeve 302 may be on side panels 312 of the outer sleeve 302. In some implementations, the interior walls may be located in other locations inside the outer sleeve 302.

The inner sleeve 304 may be inserted into the outer sleeve 302 in between two interior walls until the tab 306 locks into the outer sleeve 302. The locking mechanism can occur automatically when the tab 306 moves into a first aperture (not shown in FIG. 3, see first aperture 216 in FIG. 2) in the interior wall 318 of the outer sleeve 302, and the tab 306 moves from a position parallel to the side of the inner sleeve 304 to a position perpendicular to the side 310 of the inner sleeve 304, locking the inner sleeve 304 in place inside the interior wall 318 of the outer sleeve 302. In some implementations, the locking mechanism may not occur automatically and may require manual assistance.

In addition to locating in a position perpendicular to the side 310 of the inner sleeve 304, the tab 306 is now parallel or flush with the front panel 320 of the outer sleeve 302. In FIG. 3, a second aperture 322 is located in the bottom panel (not shown) and on a side panel 312 of the outer sleeve 302. An instrument or key (not shown) may be inserted into second aperture 322, to depress or push down on the tab 306 until it is flush or parallel with the side 310 of the inner sleeve 304 to unlock the inner sleeve 304 from the outer sleeve 302, and allow the inner sleeve 304 to slide out of the outer sleeve 302. Once the inner sleeve 304 is removed from the outer sleeve 302, contents in the inner sleeve 304 are accessible. In some implementations, other apertures may be contemplated for access to the locking mechanism.

In the implementation shown in FIG. 3, a window 326 is located in the front panel 320 of the outer sleeve 302. The window 326 may be an aperture or a clear material (e.g., a plastic or a glass) for observation of items held in the compartment 314 on the front panel 330 of the inner sleeve 304.

In some implementations, as shown in FIG. 3, the inner sleeve 304 may have a pull tab 334 for easier insertion and removal of the inner sleeve 304 into and from the outer sleeve 302. In some implementations, a locking mechanism in the packaging apparatus 300 can include a spring, a key, and/or a magnet.

The components of the packaging apparatus 300 can comprise of one or more materials (i.e., paperboard, plastic, etc.). For example, in some implementations, the packaging apparatus 300 may be paperboard of varying thickness. In some implementations, the inner sleeve 304 and the outer sleeve 302 may be paperboard and the tab 306 may be plastic. In some implementations, the interior walls of the outer sleeve 302 may have a lining made of a material different than the outer sleeve. For example, the outer sleeve 302 may be made of paperboard, and a lining on the interior walls of the outer sleeve may be plastic or another material that cannot be ripped or torn, reinforcing the child-resistant nature of the packaging apparatus 300.

Figure 4:
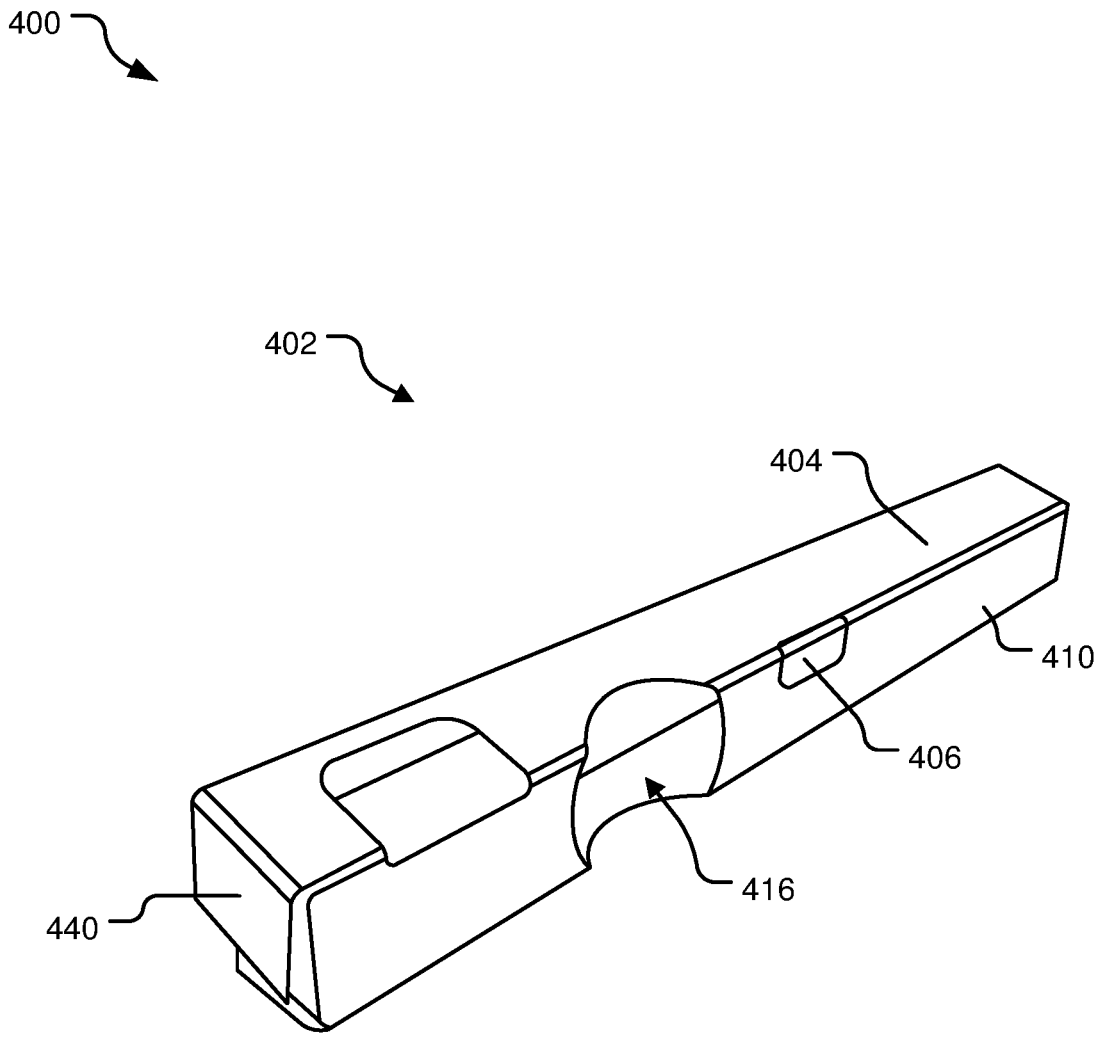
FIG. 4 illustrates a perspective view of an example packaging apparatus.

FIG. 4 illustrates a perspective view of an example packaging apparatus 400. The packaging apparatus 400 has an outer sleeve (not shown), an inner sleeve 404, and an exterior sliding locking mechanism (described more below in detail) configured to lock the inner sleeve 404 inside the outer sleeve. In some implementations, there may be more than one locking mechanism.

A dog-eared tuck 440 on the end of the inner sleeve 404 is permanently fixed, and requires tearing to open the packaging apparatus 400. In some implementations, there may packaging apparatus with one or more permanently fixed tucks.

In this implementation, the inner sleeve 404 itself holds items in place and stores items. The inner sleeve 404 can vary depending on the design and use of the packaging apparatus 400, as well as the required design for desired items to be stored in the inner sleeve 404. For example, the inner sleeve 404 may be designed to be a rectangular sleeve or have attachments or compartments to securely hold vials, bottles, electronic cigarettes, etc. in place. In some implementations, there may be multiple compartments.

The components of the packaging apparatus 400 can comprise of one or more materials (i.e., paperboard, plastic, etc.). For example, in some implementations, all the packaging apparatus 400 may be paperboard of varying thickness. In some implementations, the inner sleeve 404 and the outer sleeve may be paperboard and/or plastic. In some implementations, the interior walls of the outer sleeve may have a lining made of a material different than the outer sleeve. For example, the outer sleeve may be made of paperboard, and a lining on the interior walls of the outer sleeve may be plastic or another material that that cannot be ripped or torn, reinforcing the child-resistant nature of the packaging apparatus 400.

In this implementation, the inner sleeve 404 has ears (not shown) that are connected to the tuck 440 to facilitate the locking mechanism. The ears can be folded against the tuck 440. There are dust flaps attached to the tuck 440 that can be pushed into the inner sleeve 404 prior to closing the tuck 440 into the inner sleeve 404. The flaps can be pushed into the inner sleeve 404. An inside flap can move inside the inner sleeve 404 to keep the tuck 440 from backing out of position.

When inserting the inner sleeve 404 into the outer sleeve, a locking tab located on the outer sleeve needs to be folded inside the outer sleeve. When the inner sleeve 404 is inserted into the outer sleeve, a tab 406 located on the inner sleeve 404 can be moved or depressed toward a side 410 of the inner sleeve 404 until the tab 406 is substantially parallel or flush with the side 410 of the inner sleeve 404. As the inner sleeve 404 is pushed or slides into the outer sleeve, the locking tab located on the outer sleeve moves into an aperture (not shown) on the inner sleeve 404. In this implementation, the packaging apparatus 400 cannot be unlocked. To open the packaging apparatus 400, the packaging apparatus 400 must be torn open.

A window 416 may be an aperture or a clear material (e.g., plastic or glass) for observation or visibility of items held in the packaging apparatus 400. In some implementations, the inner sleeve 404 can be reversible and optionally be rotated 180° degrees and inserted into the outer sleeve with a bottom panel of the inner sleeve 404 observed through the window 426.

Figure 5:
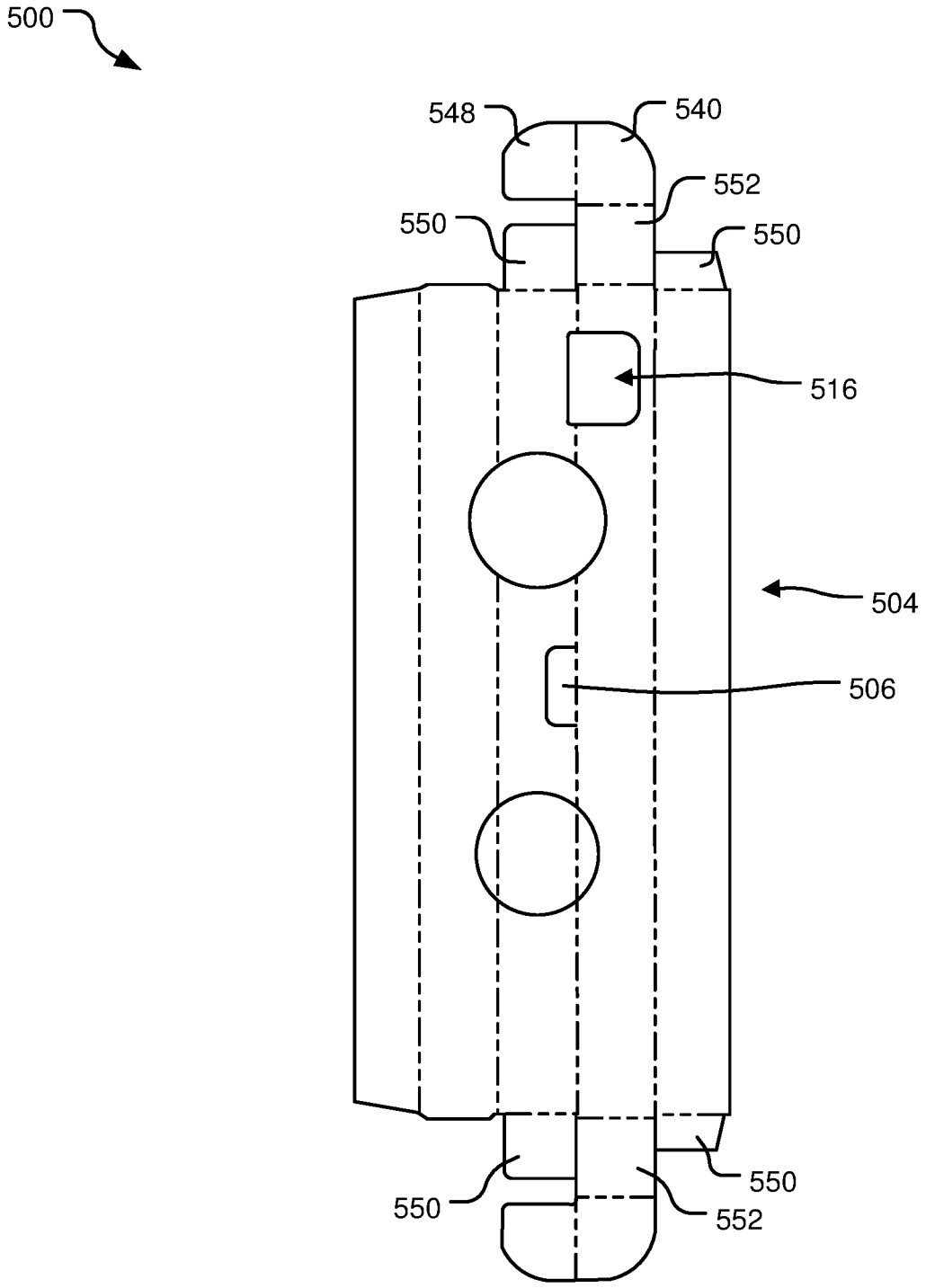
FIG. 5 illustrates a plan view of an unassembled example packaging apparatus.

FIG. 5 illustrates a side view of an unassembled example packaging apparatus 500. The packaging apparatus 500 has an outer sleeve (not shown), an inner sleeve 504, and an exterior sliding locking mechanism (described more below in detail) configured to lock the inner sleeve 504 inside the outer sleeve. The dashed lines in FIG. 5 depict where the material of the packaging apparatus may be folded when it is assembled. In some implementations, there may be more than one locking mechanism.

A dog-eared tuck 540 on the end of the inner sleeve 504 is permanently fixed, and requires tearing to open the packaging apparatus 500. In some implementations, there may packaging apparatus with one or more permanently fixed tucks.

In this implementation, the inner sleeve 504 itself holds items in place and stores items. The inner sleeve 504 can vary depending on the design and use of the packaging apparatus 500, as well as the required design for desired items to be stored in the inner sleeve 504. For example, the inner sleeve 404 may be designed to be a rectangular sleeve or have attachments or compartments to securely hold vials, bottles, electronic cigarettes, etc. in place. In some implementations, there may be multiple compartments.

The components of the packaging apparatus 500 can comprise of one or more materials (i.e., paperboard, plastic, etc.). For example, in some implementations, all the packaging apparatus 500 may be paperboard of varying thickness. In some implementations, the inner sleeve 504 and the outer sleeve may be paperboard and/or plastic. In some implementations, the interior walls of the outer sleeve may have a lining made of a material different than the outer sleeve 502. For example, the outer sleeve 502 may be made of paperboard, and a lining on the interior walls of the outer sleeve 502 may be plastic or another material that that cannot be ripped or torn, reinforcing the child-resistant nature of the packaging apparatus 500.

In this implementation, the inner sleeve 504 has ears 548 that are connected to the tuck 540 to facilitate the locking mechanism. The ears can be folded against the tuck 540. There are dust flaps 550 attached to the tuck 540 that can be pushed into the inner sleeve 504 prior to closing the tuck 540 into the inner sleeve 504. Tuck flaps 552 attached to the tuck 540 can be pushed into the inner sleeve 504. The ears 548 can move inside the inner sleeve 504 to keep the tuck 440 from backing out of position.

When inserting the inner sleeve 504 into the outer sleeve, a locking tab located on the outer sleeve needs to be folded inside the outer sleeve. When the inner sleeve 504 is inserted into the outer sleeve, a tab 506 located on the inner sleeve 504 can be moved or depressed toward a side 510 of the inner sleeve 504 until the tab 506 is substantially parallel or flush with the side 510 of the inner sleeve 504. As the inner sleeve 504 is pushed or slides into the outer sleeve, the locking tab located on the outer sleeve moves into an aperture 516 on the inner sleeve 504. In this implementation, the packaging apparatus 500 cannot be unlocked. To open the packaging apparatus 500, the packaging apparatus 500 must be torn open.

Figure 6:
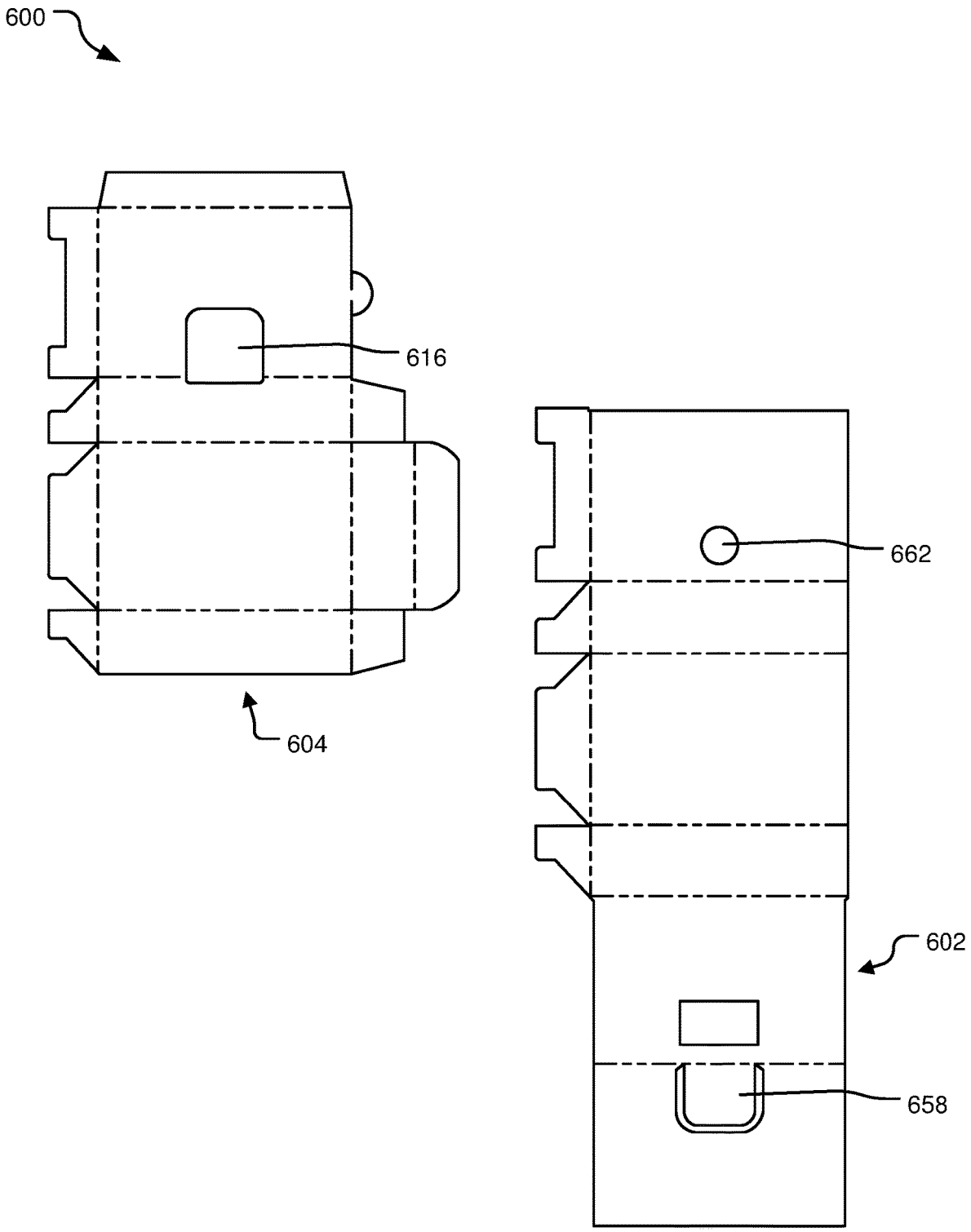
FIG. 6 illustrates a plan view of an unassembled example packaging apparatus.

FIG. 6 illustrates a side view of an unassembled example packaging apparatus 600. The packaging apparatus 600 has an outer sleeve 602, an inner sleeve 604, and an interior sliding locking mechanism (described more below in detail) configured to lock the inner sleeve 604 inside the outer sleeve 602. In some implementations, there may be more than one locking mechanism. The dashed lines in FIG. 6 depict where the material of the packaging apparatus may be folded when it is assembled.

In the implementation shown in FIG. 6, the sliding locking mechanism includes a metal disc (not shown) affixed to a component 658 in the outer sleeve 602. The component 658 has memory, like the tabs 106, 206, 306, for example, in FIGS. 1-3, and falls into a preferred position if no external force is exhibited. The preferred positioning of the component 658 acts as a "lock" for the packaging apparatus 600 by locating the component 658 into an aperture 616 in the inner sleeve 604, and causing friction or obstruction preventing movement of the inner sleeve 604 out of the outer sleeve 602.

A marked location 662 on the outer sleeve 602 indicates a position corresponding to the lock in the interior of the outer sleeve 602, upon which a magnet key or instrument can be placed and moved to unlock the packaging apparatus 600. The packaging apparatus is unlocked when the magnet key moves across the surface of the outer sleeve 602 from the marked location 662, pulling or moving the component 658 of the outer sleeve 602 out of the aperture 616 of the inner sleeve. Once the packaging apparatus is unlocked, the inner sleeve 604 can be removed from the outer sleeve 602.

Depending on the implementation, the magnet locking mechanism may be located on various sides of the packaging apparatus 600 (i.e., top panel, side panel, etc.). In some implementations, the inner sleeve 604 can be reversible, or optionally rotated 180° degrees, as described in FIG. 1.

In some implementations, the inner sleeve 604 has a compartment for holding items in place, and for storing items. The compartment can vary depending on the design and use of the packaging apparatus 600, as well as the required design for desired items to be stored. For example, the compartment may be designed to securely hold vials, bottles, electronic cigarettes, etc. in place. In some implementations, there may be multiple compartments. In this implementation, there is no separate compartment.

The components of the packaging apparatus 600 can comprise of one or more materials (i.e., paperboard, plastic, etc.). For example, in some implementations, all the packaging apparatus 600 may be paperboard of varying thickness. In some implementations, the inner sleeve 604 and the outer sleeve 602 may be paperboard and the tab 606 may be plastic. In some implementations, the interior walls of the outer sleeve 602 may have a lining or tray made of a material different than the outer sleeve. For example, the outer sleeve 602 may be made of paperboard, and a lining on the interior walls of the outer sleeve may be plastic or another material that cannot be ripped or torn, reinforcing the child-resistant nature of the packaging apparatus 600. Or in another implementation, the inner sleeve 604 may be made of both a plastic material and a paperboard material to provide additional durability. In some implementations, scoring of the tabs may allow for memory, and different thicknesses of material may be used for rigidity. In some implementations, plastic laminate may be included in the packaging apparatus so that it is tear-proof. The tab location can vary and may be dependent on the shape of the compartment.

FIGS. 7A-F illustrates a perspective view of an example packaging apparatus 700. As shown in FIGS. 7A-F, the packaging apparatus 700 has an outer sleeve 702 and an inner sleeve 704. The dashed lines in FIGS. 7A-F depict where the material of the packaging apparatus may be folded when it is assembled. The packaging apparatus 700 has two locking mechanisms (shown and described more below in detail) configured to lock the inner sleeve 704 inside the outer sleeve 702. In other implementations, there may be one locking mechanism or multiple locking mechanisms.

Figure 7A:
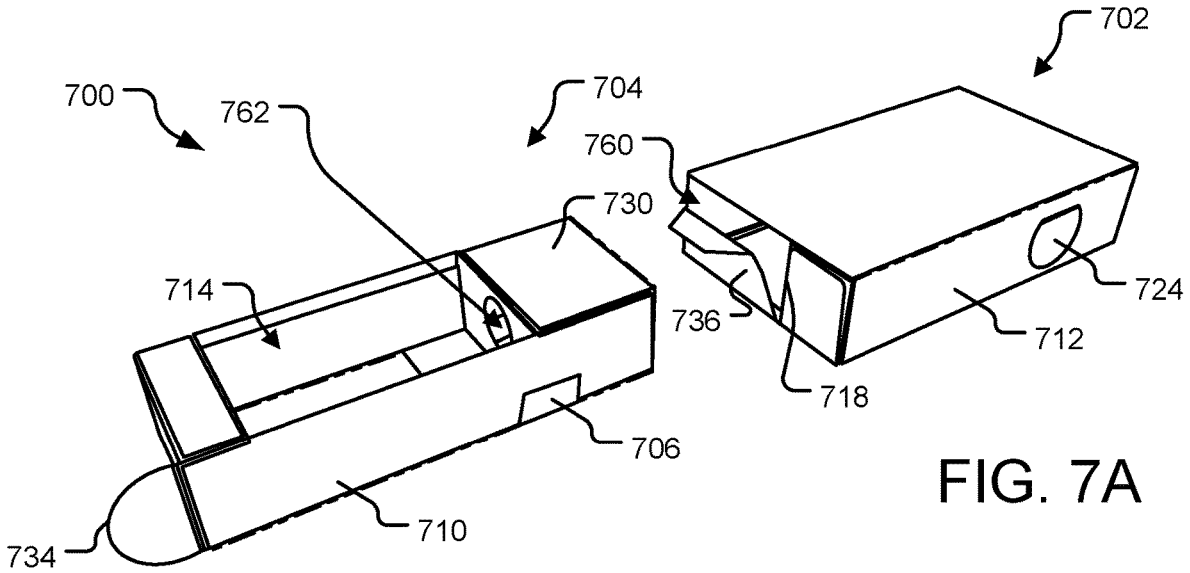
FIGS. 7A-F illustrates perspective views of an example packaging apparatus.

In the implementation shown in FIG. 7A, a first locking mechanism is an interior sliding locking mechanism, which includes a first tab 706 located on the inner sleeve 704. The first tab 706 may have a springing mechanism where the first tab 706 extends from the inner sleeve 704 in a resting condition, and when the first tab 706 is pushed against a side panel 710 of the inner sleeve 704 substantially parallel to the side panel 710 and released, the first tab 706 springs back in a preferred direction to a position extending from the inner sleeve 704.

The inner sleeve 704 has a compartment 714 on a front panel 730 for holding items in place, and for storing items in the outer sleeve 702. The compartment 714 can vary in design and shape depending on the design and use of the packaging apparatus 700, as well as the required design for desired items to be stored. For example, in some implementations, an aperture 762 is located in the compartment 714 for loading a longer cylindrical or another shaped item into the inner sleeve 704. The item may enter the aperture 762 and extend into the inner sleeve 704 in a closed compartment (not shown) beyond the compartment 714.

In some implementations, an insert may be designed for inserting into the compartment 714 configured to hold a desired item. For example, the compartment 714 or an insert designed to be inserted in the compartment 714 may be designed to securely hold vials, bottles, a vape cartridge, electronic cigarettes, other objects, etc. in place. In some implementations, there may be multiple compartments 714 or multiple inserts.

Before the inner sleeve 704 is inserted into the outer sleeve 702, the first tab 706 extends outward from an edge on the side panel 710 of the inner sleeve 704, as shown in FIG. 7A. To insert the inner sleeve 704 into the outer sleeve 702, the first tab 706 can be moved or depressed by an instrument or a user's finger toward the side panel 710 of the inner sleeve 704 until the first tab 706 is substantially parallel or flush with the side panel 710 of the inner sleeve 704.

Once the first tab 706 is substantially parallel or flush with the side panel 710 of the inner sleeve 704, the inner sleeve 704 may be inserted into the outer sleeve 702. In the implementation shown in FIG. 7A, there is an interior wall 718 between an open compartment 760 in the outer sleeve 702 and a closed compartment 738 (shown in FIG. 7E). In some implementations, there may be more than one interior wall in the outer sleeve 702. In some implementations, the interior wall 718 may be located in other locations inside the outer sleeve 702.

The inner sleeve 704 may be inserted into the open compartment 760 until the first tab 706 locks into the outer sleeve 702. The locking mechanism can occur automatically when the first tab 706 moves or springs into a first aperture 716 (shown in FIG. 7E) in the interior wall 718 of the outer sleeve 702. The first tab 706 may move in a range of positions, for example, from a position substantially parallel to the side of the inner sleeve 704 to a position protruding from the side panel 710 of the inner sleeve 704, extending through the first aperture 716 locking the inner sleeve 704 in place inside the interior wall 718 of the outer sleeve 704. In some implementations, the locking mechanism may not occur automatically and may require manual assistance.

In FIG. 7A, a first flap 724 is located in the first side panel 712 of the outer sleeve 702. A user's finger, instrument or key (not shown) may depress the first flap 724 into the closed compartment 738 of the outer sleeve 704. Moving the first flap 724 into the closed compartment 738 provides access for a user to depress or push the first tab 706. The first tab 706 may be moved from a position protruding from the side panel of the inner sleeve to a position substantially parallel to the side panel of the inner sleeve inside the closed compartment 738, and through the first aperture 716, to unlock the inner sleeve 704 from the outer sleeve 102, and allow the inner sleeve 704 to slide out of the outer sleeve 702 while the user's finger, an instrument or a key is engaged. Once the inner sleeve 704 slides out of the outer sleeve 702, contents in the inner sleeve 704 are accessible. In some implementations, other apertures may be contemplated for access to the locking mechanism.

In some implementations, a second locking mechanism (described in more detail in FIGS. 11A-F) also locks the inner sleeve 704 in the outer sleeve 702. The second locking mechanism is located between an exterior surface of a bottom panel of the inner sleeve 704 and the interior surface of the bottom panel of the outer sleeve 702, and permits the inner sleeve 704 to be removed partially out of the outer sleeve 702 but does not permit the inner sleeve 704 to be removed entirely out of the outer sleeve 702.

One component used in the second locking mechanism is a second tab 736 connected to a bottom panel of the outer sleeve 702 shown in FIG. 7A. The second tab 736 may be folded down inside the outer sleeve 702 before the inner sleeve 704 is inserted into the open compartment 760 of the outer sleeve 702. A third tab (not shown) is connected to a bottom panel of the inner sleeve 704 and may be folded down under the inner sleeve 704 to a position substantially parallel to an exterior surface of the bottom panel before the inner sleeve 704 is inserted into the outer sleeve 702. A second flap (not shown) is located in the bottom panel of the inner sleeve 704 and opens into the inner sleeve 704 creating an aperture (not shown). When the inner sleeve 704 is pulled out of the outer sleeve 702, the second tab 736 moves into the aperture in the bottom panel of the inner sleeve 704 and contacts the third tab. In response to the second tab 736 contacting the third tab, the second tab 736 moves out of the aperture and inner sleeve 704 and back into the outer sleeve 702 becoming lodged between the third tab and the exterior surface of the bottom panel of the inner sleeve, facilitating the locking mechanism of the packaging apparatus 700.

In some implementations, as shown in FIG. 7A, the inner sleeve 704 may have a pull tab 734 for easier insertion and removal of the inner sleeve 704 into and out of the outer sleeve 702. In some implementations, a locking mechanism in the packaging apparatus 100 can include a spring, a key, and/or a magnet.

Figure 7B:
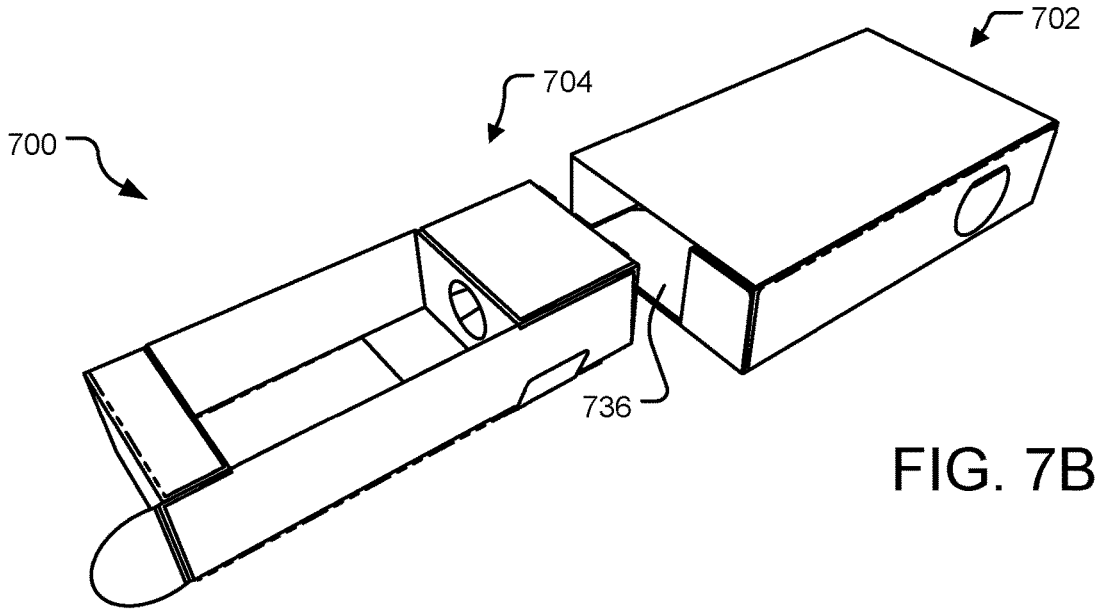

FIG. 7B illustrates the second tab 736 folded down inside the open compartment 738 of the outer sleeve 702 of the packaging apparatus 700. Once the second tab 736 is folded down inside the outer sleeve 702, the inner sleeve 704 may be inserted into the outer sleeve 702.

Figure 7C:
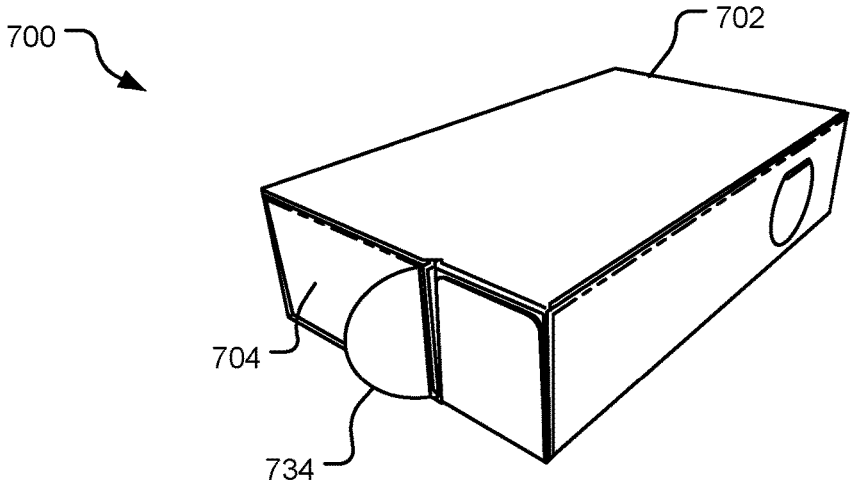

FIG. 7C illustrates the inner sleeve 704 fully inserted into the outer sleeve 702 in a closed packaging apparatus 700. The pull tab 734 is shown extending from the inner sleeve 704 for insertion and removal of the inner sleeve 704 into and from the outer sleeve 702.

Figure 7D:
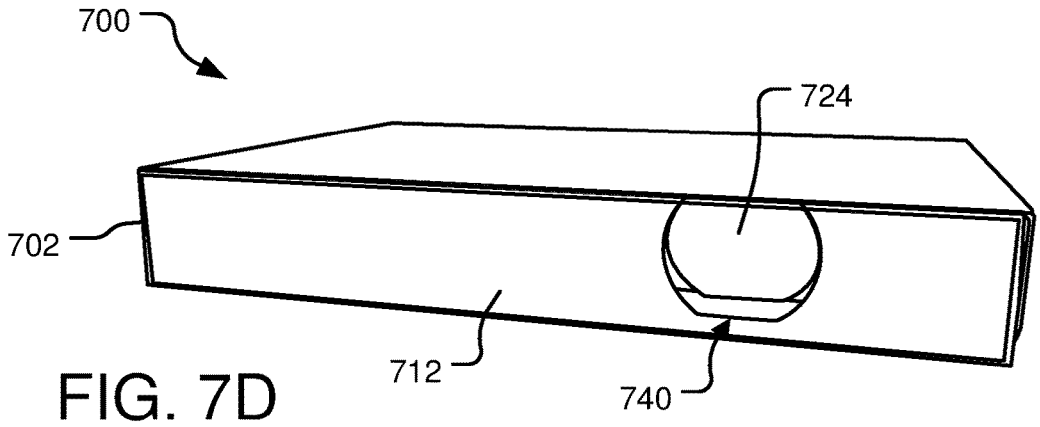

FIG. 7D illustrates the inner sleeve 704 fully inserted into the outer sleeve 702 in a closed packaging apparatus 700. A flap 724 is located in the first side panel 712 of the outer sleeve 702. A user can press on the flap 724 and push the flap 724 into a closed compartment (not shown) inside the outer sleeve 702, creating a second aperture 740 for access to the first tab 706 in the first locking mechanism.

Figure 7E:
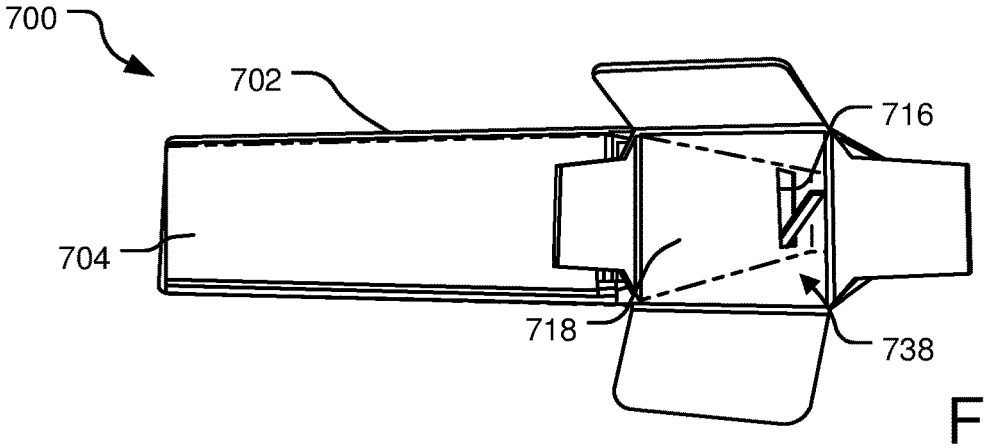

FIG. 7E illustrates an interior view of the closed compartment 738 inside the outer sleeve 702 located between the interior wall 718 of the inner sleeve 704 and the side panel (not shown) of the outer sleeve 702. In FIG. 7E, the first tab 706 is shown extending from the inner sleeve 704 through a first aperture 716 in the interior wall 718 of the outer sleeve 702. The first tab 706 is configured to move in a range of positions, from a position parallel to the side of the inner sleeve 704 to a position perpendicular to the side of the inner sleeve 704. When the first tab 706 is in a position extending through the first aperture 716 and into the closed compartment 738, the inner sleeve 704 is locked in the outer sleeve 704. When a user presses the first tab 706 to a position parallel to the side of the inner sleeve 704 and through the first aperture 716, the user can unlock the packaging apparatus 700 and slide the inner sleeve 704 out of the outer sleeve 704, opening the packaging apparatus 700.

Figure 7F:
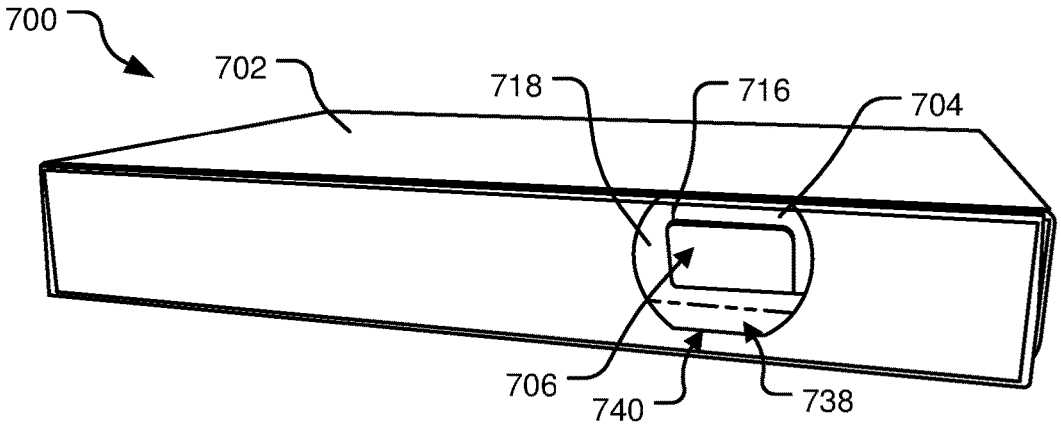

FIG. 7F illustrates a view through the second aperture 740 into the closed compartment 738 inside the outer sleeve 702. In FIG. 7F, the first tab 706 is shown extending from the inner sleeve 704 through the first aperture 716 in the interior wall 718 of the outer sleeve 702. The first tab 706 is configured to move in a range of positions, from a position parallel to the side of the inner sleeve 704 to a position perpendicular to the side of the inner sleeve 704. When the first tab 706 is in a position extending through the first aperture 716 and into the closed compartment 738, the inner sleeve 704 is locked in the outer sleeve 702. When a user presses the first tab 706 to a position parallel to the side of the inner sleeve 704, the user can unlock the packaging apparatus 700 and slide the inner sleeve 704 out of the outer sleeve 702, opening the packaging apparatus 700.

In some implementations of the disclosed technology, there may be multiple locking mechanisms, multiple windows, multiple tabs or other locks, multiple apertures for locking and for unlocking, multiple compartments, multiple materials, and reversible routes of entry of the inner sleeve into the outer sleeve. Some implementations may be configured for one-time use or multiple uses.

Figure 8:
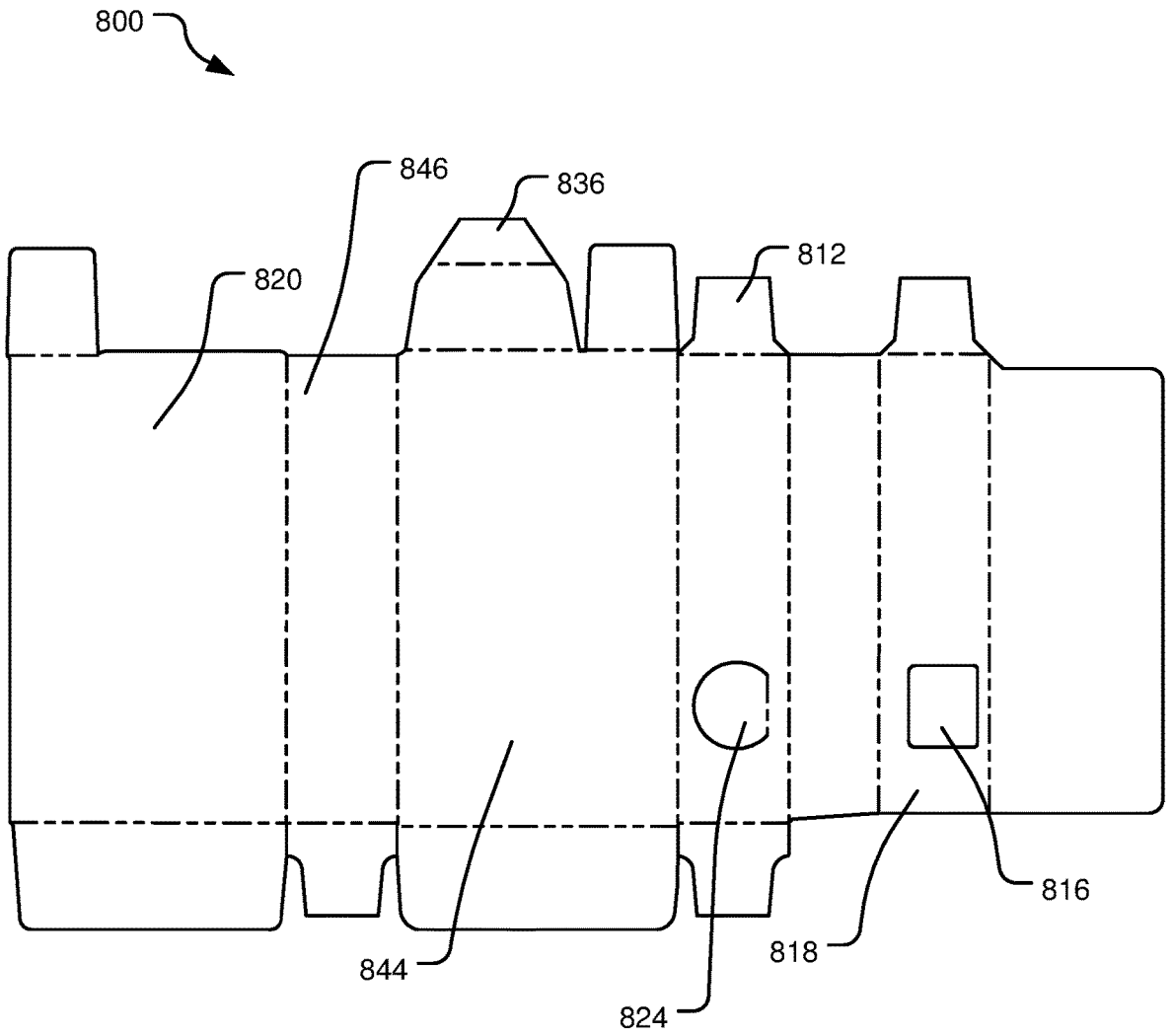
FIG. 8 illustrates a plan view of an outer sleeve of an unassembled example packaging apparatus.

FIG. 8 illustrates a side view of an outer sleeve 800 of an unassembled example packaging apparatus. The dashed lines in FIG. 8 depict where the material of the packaging apparatus may be folded when it is assembled. In one implementation, the outer sleeve 800 is shown assembled in FIG. 7A.

The four exterior walls of the outer sleeve 800, a front panel 820, a first side panel 812, a second side panel 846, and a back panel 844 are shown. Inside the outer sleeve 800, an interior compartment may be formed, which includes an interior wall 818, dividing the interior compartment into separate cavities (not shown). A first closed compartment may be configured to receive an inner sleeve (not shown), and a second closed compartment may be configured for a locking mechanism.

As shown in FIG. 8, the outer sleeve 800 has a first flap 824 located in the first side panel 812 of the outer sleeve 800. A user's finger, instrument or key (not shown) may depress the first flap 824 into a closed compartment of the outer sleeve 800, creating a second aperture (not shown) for access to an interior sliding locking mechanism (discussed in FIG. 7A). A tab on an inner sleeve (not shown) may extend from the inner sleeve through a first aperture 816 in the interior wall 818 of the outer sleeve 800 and may be depressed or pushed until it is flush or parallel with a side of the inner sleeve to unlock the inner sleeve from the outer sleeve 800, and allow the inner sleeve to slide out of the outer sleeve 800 while the user's finger, an instrument or a key is engaged. Once the inner sleeve slides out of the outer sleeve 800, contents in the inner sleeve are accessible. In some implementations, other apertures may be contemplated for access to the locking mechanism.

In some implementations, a second locking mechanism (described in more detail in FIGS. 11A-F) also locks the inner sleeve in the outer sleeve 800. The second locking mechanism is located between the bottom surface of the inner sleeve and the interior of the outer sleeve 800, and permits the inner sleeve to be removed partially out of the outer sleeve 800 but does not permit the inner sleeve to be removed entirely out of the outer sleeve 800.

One component used in the second locking mechanism is a first flap 836 connected to the outer sleeve 800, shown in FIG. 8. The first flap 836 may be folded down inside the open compartment of the outer sleeve 800 before the inner sleeve is inserted into the outer sleeve 800. A second flap (not shown) is connected to the inner sleeve and may be folded down under a bottom panel of the inner sleeve before the inner sleeve is inserted into the outer sleeve 800. A third tab (not shown) is located in the bottom surface of the inner sleeve and opens inside the inner sleeve creating an aperture (not shown). After the inner sleeve is fully inserted into the outer sleeve, the inner sleeve may be partially pulled out of the outer sleeve 800, moving the first flap 836 into the aperture in the bottom surface of the inner sleeve and contacting the third tab. When the first flap 836 contacts the third tab, the first flap 836 moves out of the aperture and inner sleeve and back into the outer sleeve 800 and on top of the second flap, facilitating the locking mechanism of a packaging apparatus.

The panels, tabs, flaps, apertures, and other components of the outer sleeve 800 may have different locations in the packaging apparatus than what is shown in FIG. 800. For example, a panel or tab may be moved in a packaging apparatus to accommodate better functioning of one of the disclosed locking mechanisms.

Figure 9:
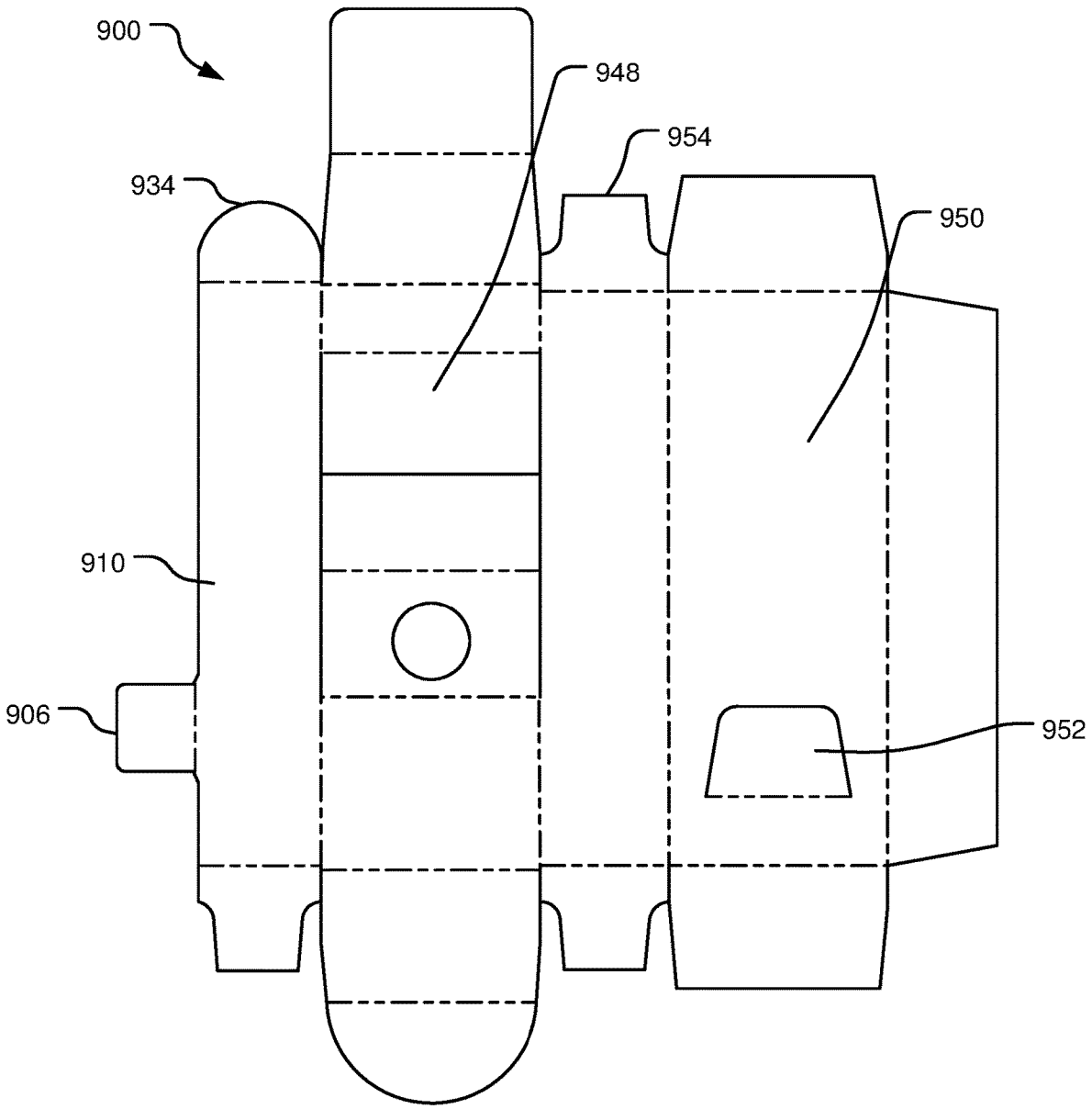
FIG. 9 illustrates a plan view of an inner sleeve of an unassembled example packaging apparatus.

FIG. 9 illustrates a side view of an inner sleeve 900 of an unassembled example packaging apparatus. The dashed lines in FIG. 9 depict where the material of the packaging apparatus may be folded when it is assembled. In one implementation, the inner sleeve 900 is shown assembled in FIG. 7A. The walls of the inner sleeve 900 are shown.

An aperture 962 is located in a compartment (not shown) formed once the packaging apparatus is assembled. The aperture 962 is used for loading a longer cylindrical or another shaped item into the inner sleeve 904. The item may enter the aperture 962 and extend into the inner sleeve 904 in a closed compartment (not shown) beyond the compartment 914. In other implementations, inserts may be used for holding, securing, and storing items in the inner sleeve 900.

A tab 906 is connected to the first side panel 910 of the inner sleeve. Once assembled, in order to insert the inner sleeve 900 into an outer sleeve (not shown) in a packaging apparatus, the tab 906 can be moved or depressed by an instrument or a user's finger toward the first side panel 910 of the inner sleeve 900 until the tab 906 substantially parallel with the first side panel 910 of the inner sleeve 900. Once the tab 906 is substantially parallel with the side 910 of the inner sleeve 900, the inner sleeve 900 may be inserted into the outer sleeve in between two interior walls of the outer sleeve 900.

The inner sleeve 900 may be inserted into an open compartment in the outer sleeve until the tab 906 locks into the outer sleeve. The locking mechanism can occur automatically when the tab 906 moves or springs into a first aperture (not shown in FIG. 7A, see first aperture 716 in FIG. 7E) in an interior wall (not shown) of the outer sleeve. The tab 906 may move in a range of positions, for example, from a position substantially parallel to the side of the inner sleeve 900 to a position protruding from the side 910 of the inner sleeve 900, extending through a first aperture (not shown) locking the inner sleeve 900 in place inside the interior wall of the outer sleeve.

A user's finger, instrument or key (not shown) may depress a flap into the outer sleeve, wherein the tab 906 may be depressed or pushed until it is flush or parallel with the side 910 of the inner sleeve 900 to unlock the inner sleeve 900 from the outer sleeve, and allow the inner sleeve 900 to slide out of the outer sleeve while the user's finger, an instrument or a key is engaged.

In some implementations, there may be more than one locking mechanism. A third tab 952 is shown and located on the bottom of the inner sleeve 904. Once the inner sleeve 900 is assembled, the third tab 956 may be folded down under the bottom panel of the inner sleeve 900 before the inner sleeve 900 is inserted into the outer sleeve.

The second flap 952 opens into the inner sleeve 904 creating an aperture (not shown). When the inner sleeve 900 is pulled out of the outer sleeve, a second flap 952 moves into the aperture in the bottom panel of the inner sleeve 900 and contacts the third tab 956. When the second flap 952 contacts the third tab 956, the second flap 952 moves out of the aperture and into the outer sleeve wedging between the second tab and the exterior surface of the bottom panel of the inner sleeve, facilitating another locking mechanism of the packaging apparatus.

The panels, tabs, flaps, apertures, and other components of the outer sleeve 900 may have different locations in the packaging apparatus than what is shown in FIG. 900. For example, a second flap 952 may be moved in the outer sleeve 900 to located between different panels to accommodate better functioning of one of the disclosed locking mechanisms.

FIG. 10A-E illustrates perspective views of example packaging apparatus inserts 1000. An inner sleeve of a packaging apparatus may be configured to receive at least one insert. Each packaging apparatus insert is configured to receive components of predetermined sizes. The predetermined sizes are based on the intended use of each packaging apparatus and various sizes and configurations are contemplated.

Figure 10A:
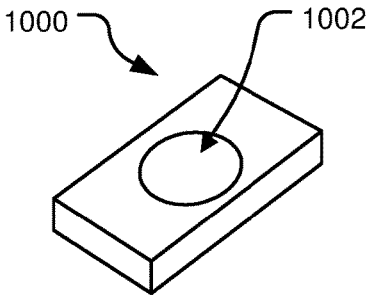
FIG. 10A-E illustrates perspective views of example packaging apparatus inserts.

For example, if a packaging apparatus was intended to hold and store a circular pharmaceutical bottle, the insert 1000 in FIG. 10A is configured to hold and secure a circular bottle. As shown, the insert 1000 in FIG. 10E includes a circular aperture 1002 configured to receive and secure a circular container.

Figure 10B:
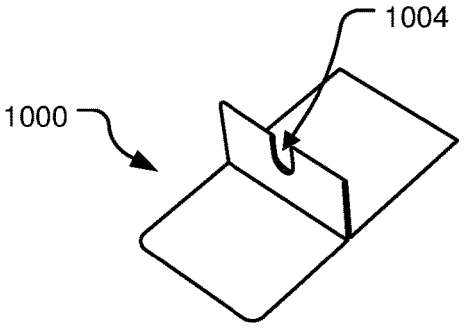

In another example, if a packaging apparatus was intended to hold and store a cylindrical pharmaceutical vial, the insert 1000 in FIG. 10B is configured to hold and secure a cylindrical container. As shown, the insert 1000 in FIG. 10B includes a mouth 1004 configured to receive a cylindrical container.

Figure 10C:
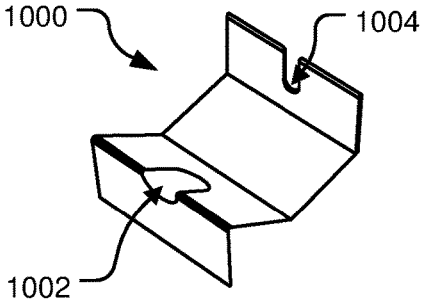
Figure 10D:
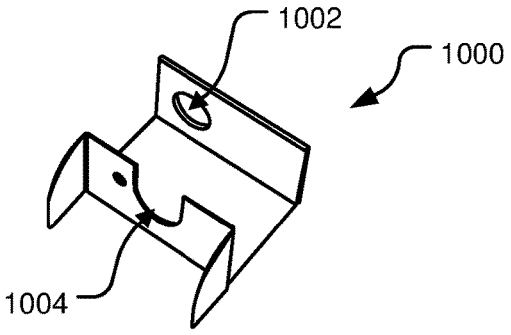
Figure 10E:
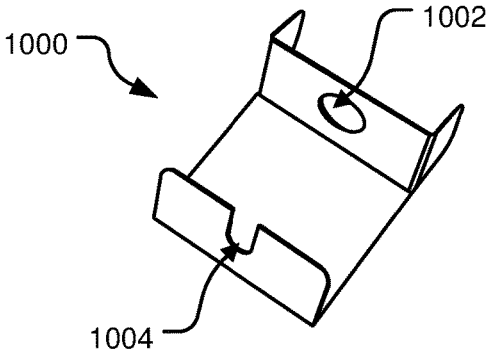

In yet other examples, if a packaging apparatus was intended to hold and store a cylindrical pharmaceutical vial, the insert 1000 in FIGS. 10C-E are configured to hold and secure cylindrical containers. As shown, the inserts 1000 in FIG. 10C-E all include an aperture 1002 to slide a first end of a vial (not shown) into and a mouth 1004 configured to receive the second end of the vial. In other implementations, other apertures, mouths, or other similar receiving and securing items may be included in a packaging apparatus insert depending on the desired use.

FIGS. 11A-F illustrates isometric perspective views of an example packaging apparatus 1100. The packaging apparatus 1100 has an outer sleeve 1102 and an inner sleeve 1104. The packaging apparatus 1100 has one locking mechanism configured to lock the inner sleeve 1104 inside the outer sleeve 1102. In other implementations, there may be more than one locking mechanism. In FIGS. 11A-F, the packaging apparatus 1100 is shown unassembled, assembled, and then partially opened and locked by the locking mechanism.

In the implementation shown in FIG. 11A-F, the locking mechanism is an interior sliding locking mechanism located between the bottom panel of the inner sleeve 1104 and the bottom of the outer sleeve 1102. Once the inner sleeve 1104 has been fully inserted into the outer sleeve 1102, the locking mechanism described in FIGS. 11A-F permits the inner sleeve 1104 to be removed partially out of the outer sleeve 1102 but does not permit the inner sleeve 1104 to be removed entirely out of the outer sleeve 1102.

Figure 11A:
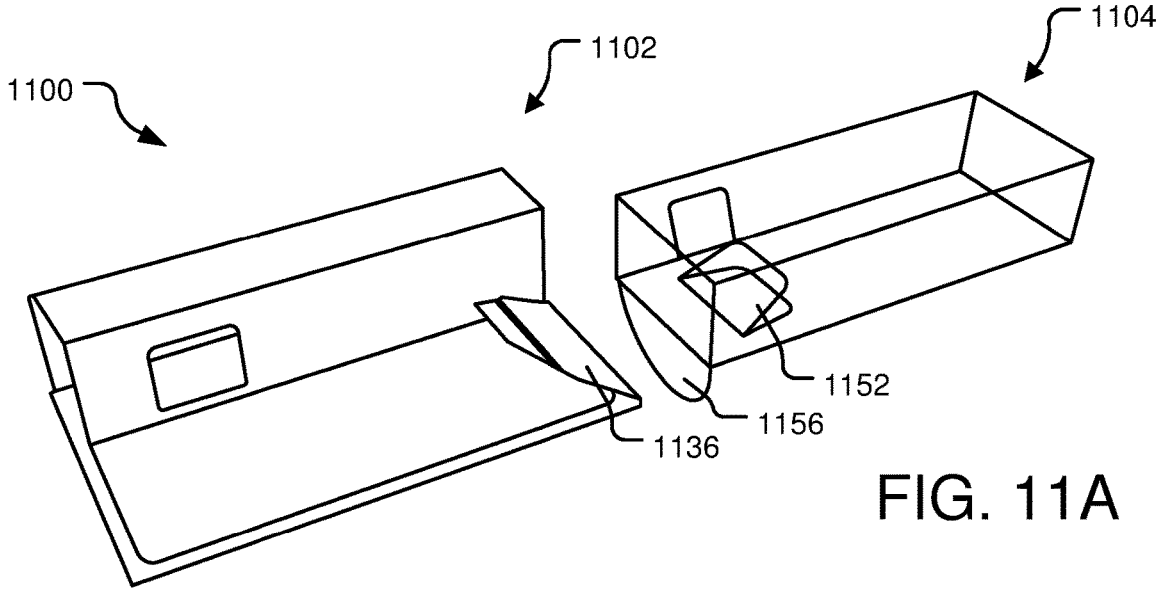
FIG. 11A-F illustrates perspective views of an example packaging apparatus.

Referring to FIG. 11A, the packaging apparatus 1100 is shown unassembled. There are three main components utilized in the locking mechanism. Two of the components in the locking mechanism include a first tab 1136 connected to a bottom panel of the outer sleeve 704 and a second tab 1156 connected to a bottom panel of the inner sleeve 1104. Both the first tab 1136 and the second tab 1156 have a range of motion to move approximately 360°. Prior to inserting the inner sleeve 1104 into the outer sleeve 1102, the first tab 1136 is folded into the interior of the outer sleeve 1102 in a position substantially parallel to the interior bottom panel of the outer sleeve 1102 and the second tab 1156 is folded outside and downward to a position substantially parallel to the exterior bottom panel of the inner sleeve 1104. The third component in the locking mechanism is a first flap 1152. The first flap 1152 is configured to move into the interior of the inner sleeve 1104 creating an aperture 1158.

Figure 11B:
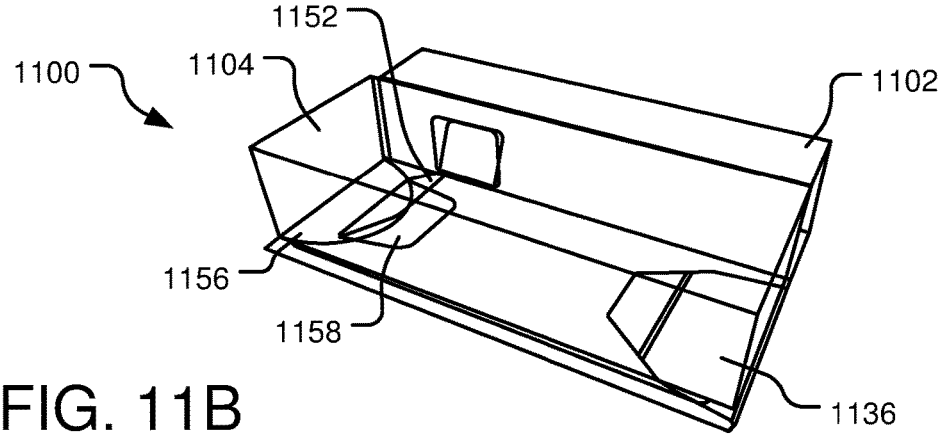

Referring to FIG. 11B, the packaging apparatus 1100 is shown assembled. The inner sleeve 1104 is inserted into the outer sleeve 1102. The alignment of the three main components utilized in the locking mechanism is shown. The first tab 1136, which was folded into the interior of the outer sleeve 1102 in a position substantially parallel to the interior surface of the bottom panel of the outer sleeve 1102 is located between the bottom surface of the bottom panel of the inner sleeve 1104 and the top surface of the bottom panel of the outer sleeve 1102. The second tab 1156, which was folded outside and downward to a position substantially parallel to the exterior surface of the bottom panel of the inner sleeve 1104 is also located between the bottom surface of the bottom panel of the inner sleeve 1104 and the top surface of the bottom panel of the outer sleeve 1102. The first flap 1152 is in a position extending inside the inner sleeve 1104, creating an aperture 1158.

Figure 11C:
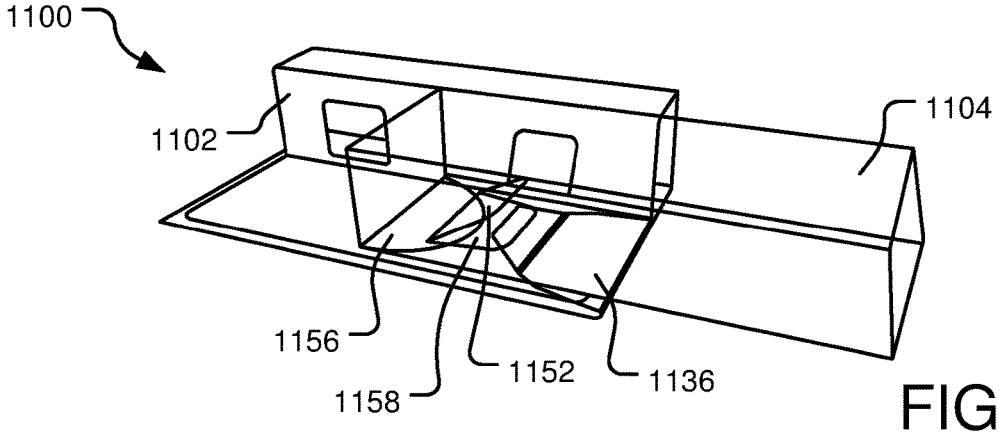

Referring to FIG. 11C, the packaging apparatus 1100 is shown as it is partially opened. When the inner sleeve 1104 is moved partially out of the outer sleeve 1102, the locking mechanism prevents the inner sleeve 1104 from being completely removed from the outer sleeve 1102. As shown in FIG. 11C, as the inner sleeve 1104 slides out of the outer sleeve 1102, the first tab 1136 moves into the aperture 1158 in the bottom panel of the inner sleeve 1104. The second tab 1156 remains positioned substantially parallel to the bottom panel of the inner sleeve 1104.

Figure 11D:
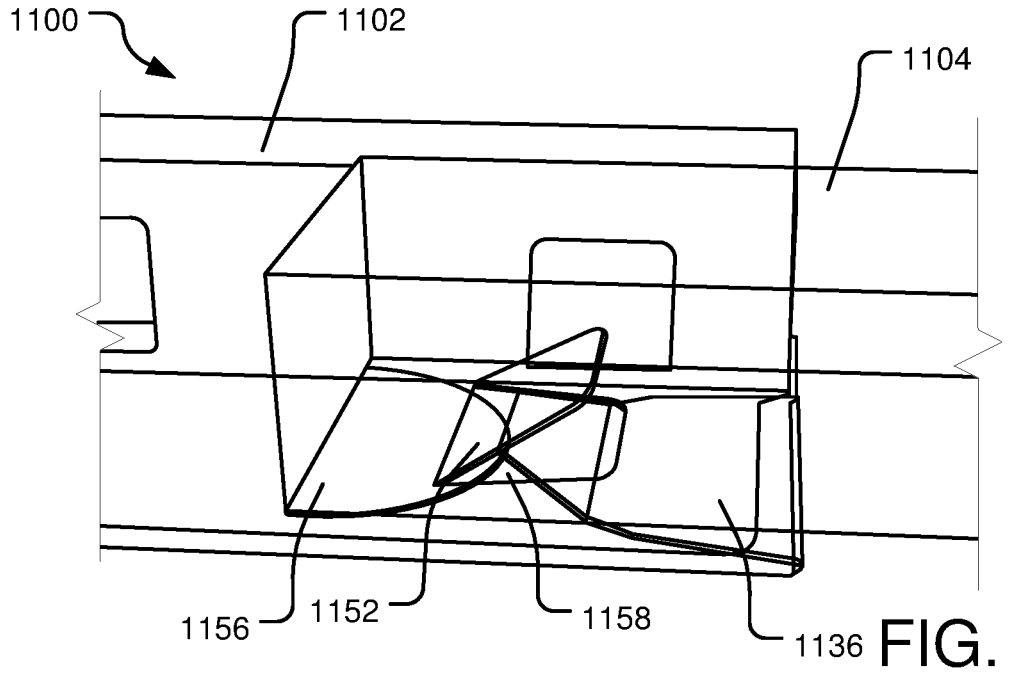

Referring to FIG. 11D, the packaging apparatus 1100 is shown as it is partially opened, and the locking mechanism occurs. As the inner sleeve 1104 is moved partially out of the outer sleeve 1102, the first tab 1136 contacts the first flap 1152. When the first tab 1136 contacts the first flap 1152, the first tab 1136 moves out of the aperture 1158 to the outer sleeve 1102 and locates on top of the second tab 1156.

Figure 11E:
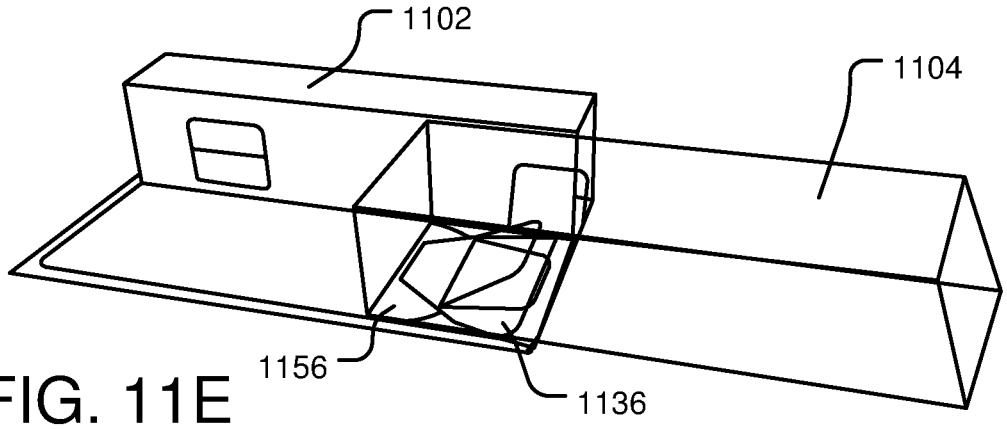

Referring to FIG. 11E, the packaging apparatus 1100 is shown as it is partially opened, and the locking mechanism has occurred. After the first tab 1136 moves out of the aperture 1158 to the outer sleeve 1102 and locates on top of the second tab 1156, the first tab 1136 is trapped between the second tab 1156 and the exterior surface of the bottom panel of the inner sleeve 1104. The locking mechanism prevents the inner sleeve 1104 from being completely removed from the outer sleeve 1102.

Figure 11F:
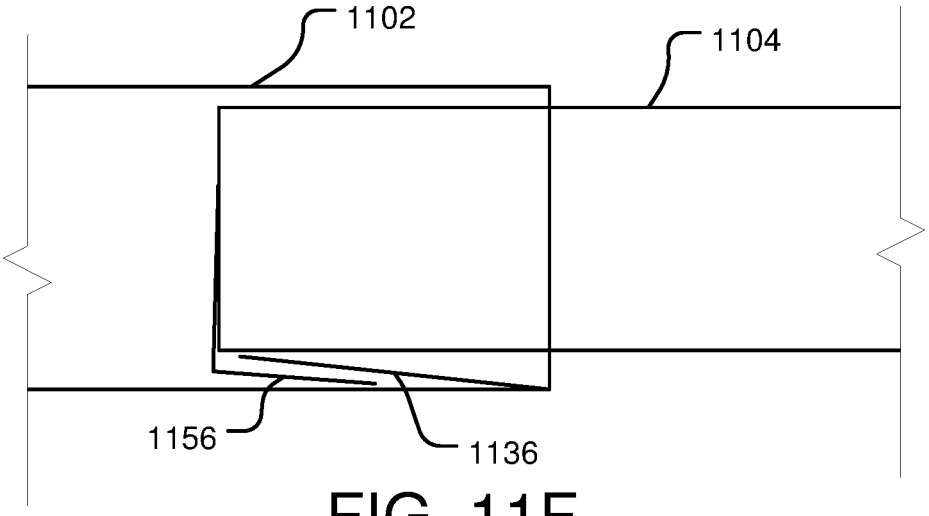

Referring to FIG. 11F, the packaging apparatus 1100 is shown in a schematic diagram as the packaging apparatus 1100 is partially opened, and the locking mechanism has occurred.

Figure 12:
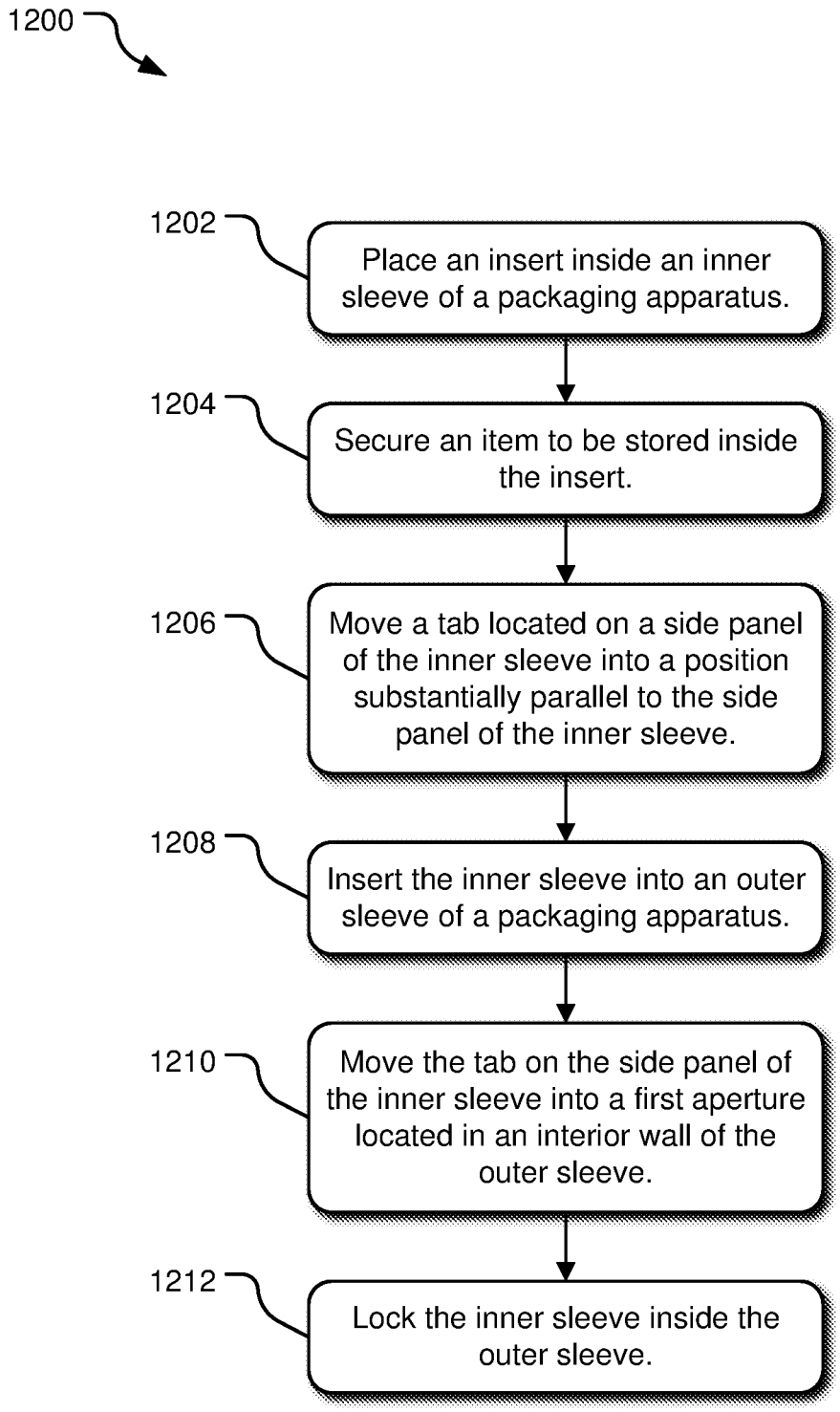
FIG. 12 is a flowchart of example operations of locking a packaging apparatus.

FIG. 12 is a flowchart of example operations of locking a packaging apparatus. An operation 1202 places an insert inside an inner sleeve of a packaging apparatus. An insert may be a specific insert configured to secure and store an intended item. In some implementations, there may be no insert and an item be placed directions into a compartment in the inner sleeve.

An operation 1204 secures an item to be stored inside the insert. Once the item is placed into the insert, or a compartment in the inner sleeve, the item may be secured. In some implementations, the item may be placed in a mouth or aperture in an insert or compartment that is configured to hold the item and prevent the item from moving within the inner sleeve. An item may be, for example, a glass vial that could break if it moved around the inner sleeve. Securing the item can protect the item from breakage.

An operation 1206 moves a tab located on a side panel of the inner sleeve into a position substantially parallel to the side panel of the inner sleeve. The substantially parallel placement of the tab allows the inner sleeve to be inserted into an outer sleeve of a packaging apparatus in an operation 1208. An operation 1210 moves the tab on the side panel of the inner sleeve into a first aperture located in an interior wall of the outer sleeve. An operation 1212 locks the inner sleeve inside the outer sleeve by protruding through the aperture enough to prevent the inner sleeve from moving inside the outer sleeve.

Figure 13:
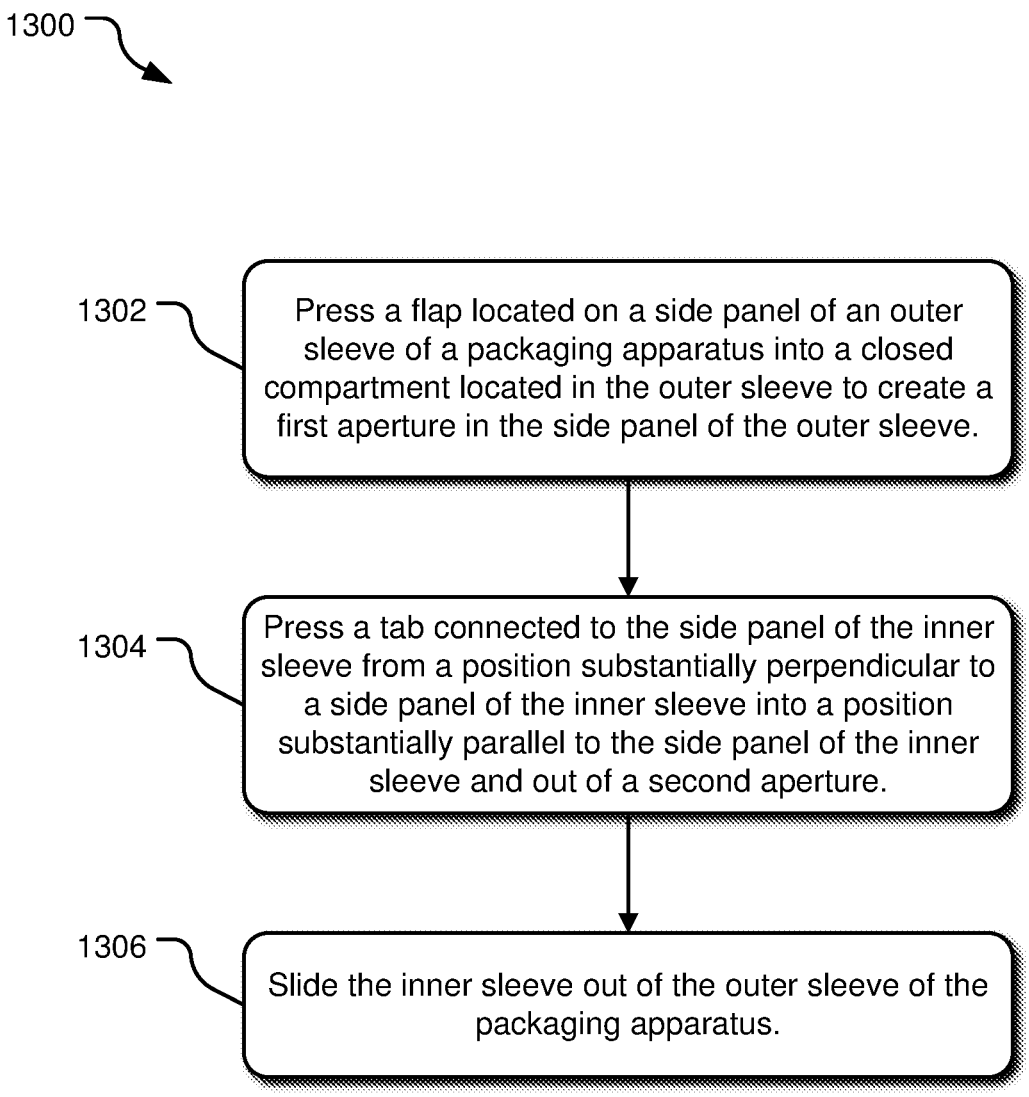
FIG. 13 is a flowchart of example operations of unlocking a packaging apparatus.

FIG. 13 is a flowchart of example operations of unlocking a packaging apparatus. An operation 1302 presses a flap located on a side panel of an outer sleeve of a packaging apparatus into a closed compartment in the outer sleeve to create a first aperture in the side panel of the outer sleeve. An operation 1304 presses a tab connected to the side panel of the inner sleeve from a position protruding from a side panel of the inner sleeve into a position substantially parallel to the side panel of the inner sleeve and out of a second aperture. Once the tab has substantially parallel placement to the side panel, the inner sleeve maybe be moved out of the outer sleeve. An operation 1306 slides the inner sleeve out of the outer sleeve of the packaging apparatus.

Figure 14:
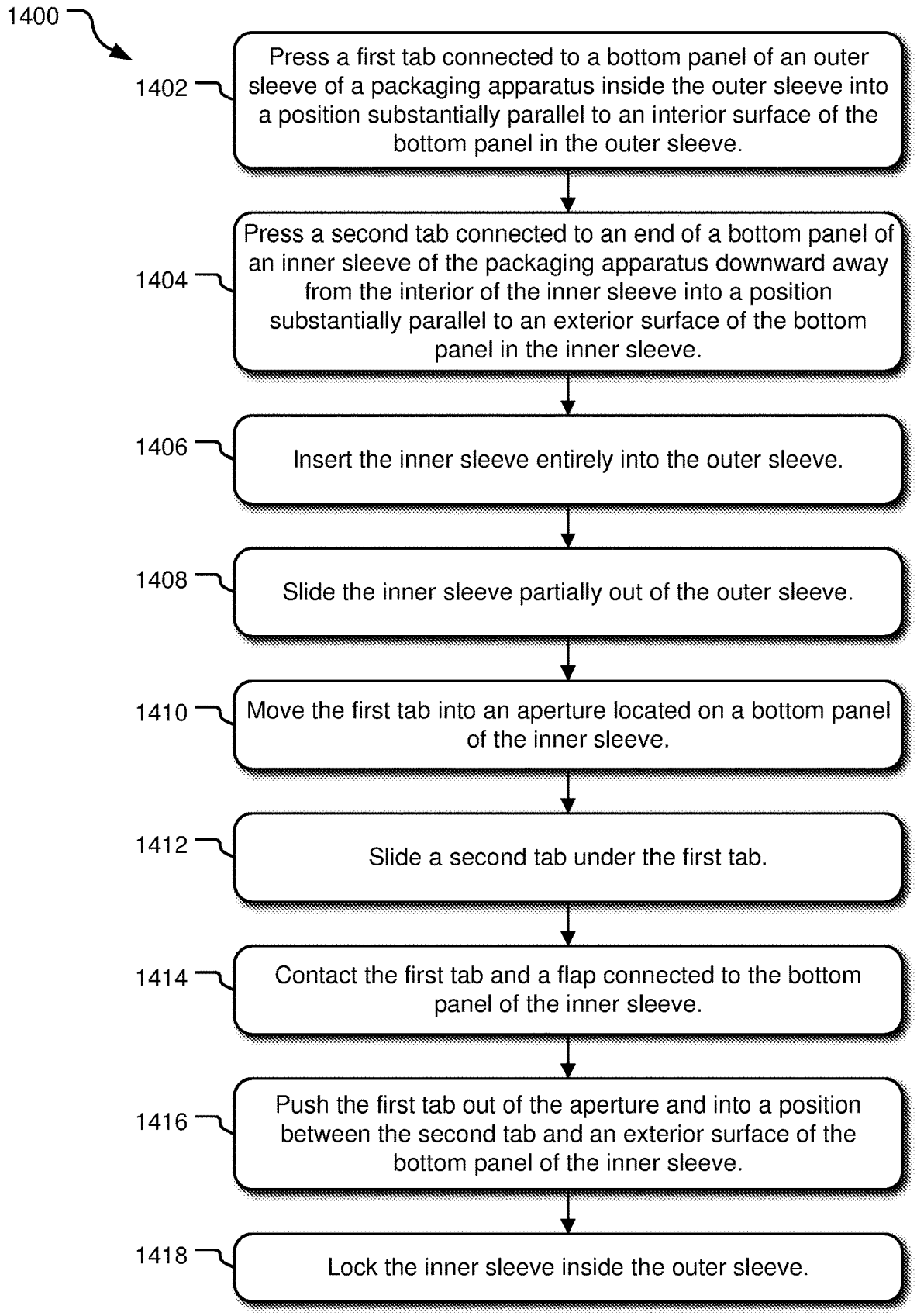
FIG. 14 is a flowchart of example operations of locking a packaging apparatus.

FIG. 14 is a flowchart of example operations of locking a packaging apparatus. An operation 1402 presses a first tab connected to a bottom panel of an outer sleeve of a packaging apparatus inside the outer sleeve into a position substantially parallel to an interior surface of the bottom panel of the outer sleeve.

An operation 1404 presses a second tab connected to an end of a bottom panel of an inner sleeve of the packaging apparatus downward away from the interior of the inner sleeve into a position substantially parallel to an exterior surface of the bottom panel in the inner sleeve.

The substantially parallel placement of the second tab allows the inner sleeve to be inserted into an outer sleeve of a packaging apparatus in an operation. An operation 1406 inserts the inner sleeve entirely into the outer sleeve.

An operation 1408 slides the inner sleeve partially out of the outer sleeve. An operation 1410 moves the first tab into an aperture located on a bottom panel of the inner sleeve. An operation 1412 slides a second tab under the first tab.

An operation 1414 contacts the first tab and a flap connected to the bottom panel of the inner sleeve. An operation 1416 pushes the first tab out of the aperture and into a position between the second tab and an exterior surface of the bottom panel of the inner sleeve. An operation 1418 locks the inner sleeve inside the outer sleeve. The inner sleeve may be partially removed from the outer sleeve but cannot be entirely removed from the outer sleeve.

The above specification, examples, and data provide a complete description of the structure and use of exemplary embodiments of the disclosed technology. Since many embodiments of the disclosed technology can be made without departing from the spirit and scope of the disclosed technology, the disclosed technology resides in the claims hereinafter appended. Furthermore, structural features of the different embodiments may be combined in yet another embodiment without departing from the recited claims.

What is claimed is:

1. A packaging apparatus comprising:

an inner sleeve;

an outer sleeve, including an open compartment and a closed compartment;

a first locking mechanism to lock the inner sleeve inside the outer sleeve responsive to sliding the inner sleeve in the open compartment of the outer sleeve, wherein the first locking mechanism locks the packaging apparatus when a first tab of the first locking mechanism located on the inner sleeve moves from a position substantially parallel to a side panel of the inner sleeve and protrudes through a first aperture in an interior wall of the outer sleeve in a position extending perpendicular to the side panel of the inner sleeve into the closed compartment of the outer sleeve, the interior wall of the outer sleeve located between the open compartment and the closed compartment; and a second aperture located in an exterior panel of the outer sleeve to provide access for a user to press the first tab of the first locking mechanism from the position extending perpendicular to the side of the inner sleeve to the position substantially parallel to the side panel of the inner sleeve to unlock the packaging apparatus and allow the inner sleeve to slide out of the open compartment of the outer sleeve of the packaging apparatus.

2. The packaging apparatus of claim 1, further comprising:

a first flap located on the exterior panel of the outer sleeve and configured to enter the closed compartment of the outer sleeve and provide the user access via the second aperture to press the first tab of the first locking mechanism.

3. The packaging apparatus of claim 2, wherein the first flap is tamper-evident.

4. The packaging apparatus of claim 1, wherein the first locking mechanism locks the inner sleeve in its entirety inside the outer sleeve.

5. The packaging apparatus of claim 1, wherein a second locking mechanism prevents the inner sleeve from sliding entirely out of the outer sleeve.

6. The packaging apparatus of claim 1, wherein the packaging apparatus includes plastic laminate.

7. The packaging apparatus of claim 1, wherein the inner sleeve of the packaging apparatus is configured to receive at least one insert, and wherein the at least one insert is configured to receive items of predetermined sizes.

8. The packaging apparatus of claim 1, further comprising:

a pull tab for removal of the inner sleeve from inside the outer sleeve.

9. The packaging apparatus of claim 1, further comprising:

a window located in a panel of the outer sleeve.

10. The packaging apparatus of claim 1, further comprising:

a permanently fixed dog-eared tuck located on an end of the inner sleeve.

11. The packaging apparatus of claim 1, wherein a second locking mechanism includes a first tab of the second locking mechanism connected to the outer sleeve located between a second tab of the second locking mechanism connected to the inner sleeve and an exterior surface of a bottom panel of the inner sleeve when the inner sleeve is within the outer sleeve.

12. The packaging apparatus of claim 11, wherein the first tab of the second locking mechanism is positioned substantially parallel to an interior surface of a bottom panel of the outer sleeve and the second tab of the second locking mechanism is positioned substantially parallel to an exterior surface of a bottom panel of the inner sleeve.

13. A method comprising:

inserting an inner sleeve into an open compartment of an outer sleeve of a packaging apparatus;

sliding the inner sleeve inside the open compartment of the outer sleeve with a first tab located on the inner sleeve in a position substantially parallel to a side panel of the inner sleeve until the first tab enters a first aperture located in an interior wall of the outer sleeve, the interior wall of the outer sleeve located between the open compartment and a closed compartment;

moving the first tab into the first aperture from the position substantially parallel to the side panel of the inner sleeve to a position extending perpendicular to the side panel of the inner sleeve into the closed compartment of the outer sleeve; and locking the inner sleeve inside the outer sleeve responsive to moving the first tab into the first aperture.

14. The method of claim 13, further comprising:

pressing a tamper-evident flap located on a panel of the outer sleeve into the closed compartment in the outer sleeve to create a second aperture in the outer sleeve;

pressing the first tab on the inner sleeve from the position extending perpendicular to the side panel of the inner sleeve into the closed compartment of the outer sleeve to a position substantially parallel to the side panel of the inner sleeve;

pulling the inner sleeve partially from the outer sleeve of the packaging apparatus with a pull tab located on the inner sleeve;

moving the first tab through the first aperture and into the open compartment of the outer sleeve;

unlocking the inner sleeve from the outer sleeve responsive to moving the first tab through into the open compartment of the outer sleeve.

15. The method of claim 13, wherein the packaging apparatus includes at least one of paperboard and plastic.

16. The method of claim 13, wherein the inner sleeve is locked in its entirety inside the outer sleeve.

17. The method of claim 13, further comprising:

placing at least one insert into the inner sleeve, and wherein the at least one insert receives items of predetermined sizes.

18. A locking packaging container comprising:

an outer sleeve, the outer sleeve including:

an open compartment;

a closed compartment; and an interior wall located between the open compartment and the closed compartment, the interior wall including a first aperture; and an inner sleeve, the inner sleeve including:

a first tab, the first tab configured to move from a position substantially parallel to a side panel of the inner sleeve when sliding the inner sleeve in the open compartment of the outer sleeve and protrude through the first aperture in the interior wall of the outer sleeve in a position extending perpendicular to the side panel of the inner sleeve into the closed compartment of the outer sleeve to lock the inner sleeve in the outer sleeve.

19. The locking packaging container of claim 18, further comprising:

a second aperture located in an exterior panel of the outer sleeve to provide access for a user to move the first tab in the inner sleeve from the position extending perpendicular to the side panel of the inner sleeve to the position substantially parallel to the side panel of the inner sleeve to unlock the inner sleeve from the outer sleeve and allow the inner sleeve to slide from the open compartment of the outer sleeve of the packaging apparatus.

20. The locking packaging container of claim 19, further comprising:

a first flap located on the exterior panel of the outer sleeve and configured to enter the closed compartment of the outer sleeve and provide the user access via the second aperture to move the first tab in the inner sleeve from the position extending perpendicular to the side of the inner sleeve to the position substantially parallel to the side panel of the inner sleeve to unlock the inner sleeve from the outer sleeve.

* * * * *